US007527906B2

(12) United States Patent
Yu et al.

(10) Patent No.: US 7,527,906 B2
(45) Date of Patent: May 5, 2009

(54) IMAGING MEMBER HAVING ADJUSTABLE FRICTION ANTICURL BACK COATING

(75) Inventors: Robert C. U. Yu, Webster, NY (US); Stephen T. Avery, Rochester, NY (US); Edward F. Grabowski, Webster, NY (US); Satish Parikh, Rochester, NY (US); Donald J. Goodman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 194 days.

(21) Appl. No.: 11/471,471

(22) Filed: Jun. 20, 2006

(65) Prior Publication Data

US 2007/0292797 A1 Dec. 20, 2007

(51) Int. Cl.
*G03G 5/10* (2006.01)

(52) U.S. Cl. ..... 430/69; 430/56; 430/930; 399/159

(58) Field of Classification Search ..... 430/69, 430/56; 399/159
See application file for complete search history.

(56) References Cited

U.S. PATENT DOCUMENTS 3,121,006 A 2/1964 Middleton et al.
3,820,989 A 6/1974 Rule et al.
3,837,851 A 9/1974 Shattuck et al.
3,895,944 A 7/1975 Wiedemann et al.
4,150,987 A 4/1979 Anderson et al.
4,245,021 A 1/1981 Kazami et al.
4,256,821 A 3/1981 Enomoto et al.
4,265,990 A 5/1981 Stolka et al.
4,278,746 A 7/1981 Goto et al.
4,297,426 A 10/1981 Sakai et al.
4,315,982 A 2/1982 Ishikawa et al.
4,338,387 A 7/1982 Hewitt
4,338,388 A 7/1982 Sakai et al.
4,385,106 A 5/1983 Sakai
4,387,147 A 6/1983 Sakai
4,399,207 A 8/1983 Sakai et al.
4,399,208 A 8/1983 Takasu et al.
4,587,189 A 5/1986 Hor et al.
4,654,284 A 3/1987 Yu et al.
4,664,995 A 5/1987 Horgan et al.
4,988,597 A 1/1991 Spiewak et al.
5,021,309 A 6/1991 Yu
5,069,993 A * 12/1991 Robinette et al. ..... 430/58.8
5,244,762 A 9/1993 Spiewak et al.
5,697,024 A 12/1997 Mishra
5,703,487 A 12/1997 Mishra
5,756,245 A 5/1998 Esteghamatian et al.
5,919,590 A * 7/1999 Yu et al. ..... 430/56
6,008,653 A 12/1999 Popovic et al.
6,072,011 A 6/2000 Hoover
6,119,536 A 9/2000 Popovic et al.
6,124,514 A 9/2000 Emmrich et al.
6,150,824 A 11/2000 Mishra et al.
6,214,514 B1 4/2001 Evans et al.
6,528,226 B1 3/2003 Yu et al.
6,630,562 B2 * 10/2003 Ogawa et al. ..... 528/196
6,756,169 B2 6/2004 Lin et al.

(Continued)

*Primary Examiner*—Christopher RoDee
(74) *Attorney, Agent, or Firm*—Pillsbury Winthrop Shaw Pittman LLP

(57) ABSTRACT

The presently disclosed embodiments are directed to anticurl back coatings useful in electrostatography. More particularly, the embodiments pertain to an electrophotographic imaging member with an improved anticurl back coating formulated by a polymer blend comprising two low surface energy polymeric materials that prevents curling, renders surface lubricity, eliminates electrostatic charge buildup, reduces surface contact friction, and enhances abrasion/wear resistance, and a process for making and using the imaging member.

22 Claims, 1 Drawing Sheet

U.S. PATENT DOCUMENTS

| | | | | |
|---|---|---|---|---|
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 7,361,440 | B2 | 4/2008 | Mishra et al. | |
| 7,422,831 | B2 | 9/2008 | Yu | |
| 2007/0059623 | A1* | 3/2007 | Yu | 430/69 |
| 2007/0141487 | A1* | 6/2007 | Yu et al. | 430/56 |
| 2007/0141493 | A1* | 6/2007 | Evans et al. | 430/69 |

* cited by examiner

IMAGING MEMBER HAVING ADJUSTABLE FRICTION ANTICURL BACK COATING

BACKGROUND

The present disclosure relates to the preparation of a flexible electrostatographic imaging member containing a thermoplastic anticurl back coating layer. This disclosure also relates to a process for making the flexible electrostatographic imaging member for use in the electrostatographic imaging system. More particularly, the disclosed embodiments pertain to the preparation of flexible electrophotographic imaging member belts having an improved anticurl back coating comprising a blend of low surface energy polymeric materials to provide adjustment of surface coefficient of friction for achieving optimum belt drive efficiency.

Flexible electrostatographic imaging members are well known in the art. Typical flexible electrostatographic imaging members include, for example: (1) electrophotographic imaging member belts (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts; a seamed belt is usually formed by cutting a rectangular imaging member sheet from a web stock, overlapping a pair of opposite ends, and welding the overlapped ends together to form a welded seam belt. Typical electrophotographic imaging member belts include a charge transport layer (CTL) and a charge generating layer (CGL) on one side of a supporting substrate layer and an anticurl back coating (ACBC) coated onto the opposite side of the substrate layer. A typical electrographic imaging member belt does, however, have a more simple material structure; it includes a dielectric imaging layer on one side of a supporting substrate and an anticurl back coating on the opposite side of the substrate. Although the scope of the present embodiments cover the preparation of all types of flexible electrostatographic imaging members, but for reason of simplicity, the discussion hereinafter will be focused on and represented by only flexible electrophotographic imaging members.

Electrophotographic flexible imaging members may include a photoconductive layer including a single layer or composite layers. Because typical electrophotographic imaging members exhibit undesirable upward imaging member curling, an anticurl back coating is required to offset the curl. Thus, the application of the anticurl back coating is necessary to render the imaging member with appropriate flatness.

One type of composite photoconductive layer used in xerography is illustrated in U.S. Pat. No. 4,265,990 which describes an electrophotographic imaging member having at least two electrically operative layers. One layer comprises a photoconductive layer which is capable of photogenerating holes and injecting the photogenerated holes into a contiguous CTL. Generally, where the two electrically operative layers are supported on a conductive layer in a negatively charged imaging member, the photoconductive layer is sandwiched between a contiguous CTL and the supporting conductive layer. Alternatively, in a positively charged imaging member, the CTL may be sandwiched between the supporting electrode and a photoconductive layer. Electrophotographic imaging members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving paper.

In the case where the charge-generating layer (CGL) is sandwiched between the outermost exposed CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of Gen layer is charged positively while conductive layer is charged negatively and the holes are injected through from the CGL to the CTL. The CTL should be able to transport the holes with as little trapping of charge as possible. In flexible web like photoreceptor the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements, including narrow operating limits, on the imaging members. For example, the numerous layers used in many modern electrophotographic imaging members must be highly flexible, adhere well between the adjacent layers, and exhibit predictable electrical characteristics within narrow operating limits to provide excellent toner images over many thousands of cycles. One type of multilayered imaging member that has been employed as a belt in electrophotographic imaging systems comprises a substrate, a conductive layer, an optional blocking layer, an optional adhesive layer, a charge generating layer, a CTL and a conductive ground strip layer adjacent to one edge of the imaging layers, and an optional overcoat layer may be applied directly over the CTL to provide protection against surface abrasion and wear. Such an imaging member usually further comprises an anticurl back coating layer on the side of the substrate opposite to the side carrying the conductive layer, blocking layer, adhesive layer, charge generating layer, CTL, and overcoat layer.

Typical negatively-charged imaging member belts, such as flexible photoreceptor belt designs, are made of multiple layers comprising a flexible supporting substrate, a conductive ground plane, a charge blocking layer, an optional adhesive layer, a CGL, a CTL. The CTL is usually the last layer to be coated and is applied by solution coating then followed by drying the wet applied coating at elevated temperatures of about 120° C., and finally cooling it down to room ambient temperature of about 25° C. When a production web stock of several thousand feet of coated multilayered photoreceptor material is obtained after finishing application of the CTL coating through drying and cooling processes, exhibition of spontaneous upward curling of the multilayered photoreceptor is observed. This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL does therefore have a larger dimensional shrinkage than that of the substrate support as the imaging member web stock cools down to ambient room temperature. The exhibition of imaging member curling after completion of CTL coating is due to the consequence of the heating/drying/cooling processing, caused by the mechanism: (1) as the web stock carrying the wet applied CTL is dried at elevated temperature, dimensional contraction does occur when the wet CTL coating is losing its solvent during 115° C. elevated temperature drying, because the CTL at 120° C. still remains as a viscous liquid after losing its solvent. Since its glass transition temperature (Tg) is about 85° C., the CTL will flow to automatically re-adjust itself to compensate the losing of solvent and maintain its dimension; (2) as the CTL in this viscous liquid state is cooling down further and reaching its Tg at 85° C., the CTL instantaneously solidifies and adheres to the CGL as a result of its transformation from itself being a viscous liquid into a solid layer at its Tg; and (3) cooling down the solidified CTL of the imaging member web from 85° C. down to 25° C. room ambient will then effect greater dimensional CTL shrinkage than that of the substrate support, since it has 3.7 times greater thermal contraction coefficient than the substrate support. This dimensional contraction mis-match causes in tension strain buildup in the CTL as it contracts; at this instant, greater contracting in CTL is therefore pulling the imaging member inwardly to give rise to upward curling. If unrestrained at this point, the imaging member web stock will spontaneously curl upwardly into a 1.5-inch tube. To offset the curling, an anticurl back coating is then applied to the backside of the flexible substrate support, opposite to the side having the charge transport layer, and render the imaging member web stock with desired flatness.

Curling of a photoreceptor web is undesirable because it hinders fabrication of the web into cut sheets and subsequent welding into a belt. An anticurl back coating having a counter curling effect equal to and in the opposite direction to the applied layers is applied to the reverse side of the active imaging member to eliminate the overall curl of the coated device by offsetting the curl effect which is arisen from the mismatch of the thermal contraction coefficient between the substrate and the CTL, resulting in greater CTL dimensional shrinkage than that of the substrate. Although the anticurl back coating is needed to counteract and balance the curl so as to allow the imaging member web to lay flat, nonetheless, common formulations used for anticurl back coatings have often been found to provide unsatisfying dynamic imaging member belt performance under a normal machine functioning condition; for example, exhibition of excessive anticurl back coating wear and its propensity to cause electrostatic charge buildup are the frequently seen problems that prematurely cut short the service life of the photoreceptor belt and requires its frequent costly replacement in the field.

Anticurl back coating wear under the normal imaging member belt machine operational conditions reduces the anticurl back coating thickness, causing the lost of its ability to fully counteract the curl as reflected in exhibition of imaging member belt curl in the field. Curling is undesirable during imaging belt function because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the anticurl back coating is an outermost exposed backing layer and has high surface contact friction when it slides over the machine subsystems of belt support module, such as rollers, stationary belt guiding components, and various backer bars during dynamic belt cyclic function, these sliding mechanical interactions against the belt support module components not only exacerbate the rapid wearing away of anticurl back coating to result the early onset of upward photoreceptor belt edge curl, it does also cause the production of large amount of wear-debris which scatters and deposits on critical machine components such as lenses, corona charging devices and the like, to thereby adversely affecting and impeding proper machine imaging operation.

Moreover, high surface contact friction of the anticurl back coating against all these machine subsystems is further been found to cause the development of electrostatic charge buildup problem. In many machines, the electrostatic charge builds up due to high contact friction between the anticurl back coating and the backer bars is seen to significantly increase the frictional force to the point that it requires higher torque from the driving motor to pull the belt for effective cycling motion. In full color electrophotographic machines, using a 10-pitch photoreceptor belt, this electrostatic charge build-up can be extremely high due to large number of backer bars used in the machine. At times, one has to use two driving rollers, rather than one, along with a more powerful motor to effect belt drive which are to be coordinated electronically precisely to keep any possibility of belt sagging. High static charge buildup in anticurl back coating gives rise to its attraction to the back bars and adds normal force which causes an increase in frictional interaction to impact the belt drive torque; in frequent instances, this increase in frictional interaction has been found to reach the point of overcoming the drive-motor's capacity resulting in total belt stalling. In other cases, this electrostatic charge build-up can be so high as to cause sparking.

Another problem encountered in the conventional belt photoreceptors using a bisphenol A polycarbonate anticurl back coating that are extensively cycled in precision electrostatographic imaging machines utilizing belt supporting backer bars, is an audible squeaky sound generated due to high contact friction interaction between the anticurl back coating and the backer bars. Further, cumulative deposition of anticurl back coating wear debris onto the backer bars may give rise to undesirable defect print marks formed on copies because each debris deposit become a surface protrusion point on the backer bar and locally forces the imaging member belt upwardly to interferes with the toner image development process. Moreover, pushing of protrusion points (on backer bar surface by debris deposits) at the back side of the photoreceptor belt does also exacerbate the early on set CTL cracking, since these protrusion points results in high localized stress sites in the CTL. On other occasions, the anticurl back coating wear debris accumulation on the backer bars does gradually increase the dynamic contact friction between these two interacting surfaces of anticurl back coating and backer bar, interfering with the duty cycle of the driving motor to a point where the motor eventually stalls and belt cycling prematurely ceases.

In an effort to resolve the problems associated with the anticurl back coating, one known wear resistance anticurl back coating formulated for use in the printing apparatuses includes organic particles reinforcement such as the utilization of polytetrafluoroethylene (PTFE) dispersion in the anticurl back coating polymer binder. PTFE particles are commonly incorporated to reduce the friction between the anticurl back coating of the belt and the backer bars. The benefit of using this formulation is, however, out-weighed by a major drawback because of a problem associated with PTFE particle dispersion stability of the anticurl back coating solution. PTFE, being two times heavier than the coating solution, forms an unstable dispersion in a polymer coating solution, commonly a bisphenol A polycarbonate polymer solution, and tends to settle with particles flocculate themselves into big agglomerates in the mix tanks if not continuously stirred. The difficulty of achieving good PTFE dispersion in the coating solution does also pose a problem, because it can result in an anticurl back coating with insufficient and variable or inhomogeneous PTFE dispersion along the length of the coated web, and thus, inadequate reduction of friction over the backer bars in the copiers or printers. This causes significant complications in the larger copiers or printers, which often include so many backer bars that the high friction increases the torque needed to drive the belt. Consequently, two driving rollers are included and synchronized to prevent any registration error to occur. The additional components result in high costs for producing and using these larger printing apparatuses. Thus, if the friction could be reduced, the apparatus design in these larger printing apparatuses could be simplified with less components, resulting in significant cost savings. The present disclosures discussed above also contemplate dispersion of other particles, such as amorphous silica or nano particles PTFE in the solution of polymeric binder. However, these generally have a problem of creating a good particle dispersion quality consisting of only homogeneously dispersion primary particles in the resulting anticurl back coating. Moreover, the problems of instability of solutions and thus the shelf life are serious issues; and consequently, the coating solution needs to be constantly stirred. It is very important to point out that the anticurl back coating formulated to incorporate PTFE dispersion for friction reduction has not been seen to be absolutely effective to eliminate the static charge build-up problem under a normal photoreceptor belt cyclic function condition in the machine.

In U.S. Pat. No. 5,069,993, an exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder. Various specific film forming resins for the anti-curl layer and adhesion promoters are disclosed.

U.S. Pat. No. 5,021,309 shows an electrophotographic imaging device, with material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 5,919,590 shows an electrostatographic imaging member comprising a supporting substrate having an electrically conductive layer, at least one imaging layer, an anti-curl layer, an optional ground strip layer and an optional overcoat layer, the anti-curl layer including a film forming polycarbonate binder, an optional adhesion promoter, and optional dispersed particles selected from the group consisting of inorganic particles, organic particles, and mixtures thereof.

In U.S. Pat. No. 4,654,284 an electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of VITEL PE 100 in the anti-curl layer is described.

In U.S. Pat. No. 6,528,226 a process for preparing an imaging member is disclosed that includes applying an organic layer to an imaging member substrate, treating the organic layer and/or a backside of the substrate with a corona discharge effluent, and applying an overcoat layer to the organic layer and/or an anticurl back coating to the backside of the substrate.

There have been other anticurl back coating formulations disclosed in the art, such as for example, U.S. Pat. No. 7,361,440 entitled "Anticurl Backing Layer for Electrostatographic Imaging Members" to Mishra et al., filed on Aug. 9, 2005, and U.S. Pat. No. 7,422,831 entitled "Anticurl Back Coating Layer for Electrostatographic Imaging Members" to Yu, filed on Sep. 15, 2005. While these formulations serve their intended purposes, further improvement on those formulations are desirable.

Thus, flexible electrophotographic imaging members comprising a supporting substrate, having a conductive surface on one side, coated over with at least one photoconductive layer and coated on the other side of the supporting substrate with a conventional anticurl back coating that does exhibit deficiencies which are undesirable in advanced automatic, cyclic electrophotographic imaging copiers, duplicators, and printers. While the above mentioned electrophotographic imaging members may be suitable or limited for their intended purposes, further improvement on these imaging members are desirable and urgently needed. For example, there continues to be the need for improvements in such systems, particularly for an imaging member belt that includes an improved anticurl back coating which sufficiently counters and balances curling to render flatness, reduces surface contact friction, gives effective drive-roll belt drive capacity, has superb wear resistance, provides lubricity to ease belt drive over each back bar, produces little or no wear debris generation, eliminates electrostatic charge build-up problem, and is free of belt stalling occurrence altogether, even photoreceptor belt function in large printing/imaging apparatuses.

SUMMARY

In one embodiment, there is provided an imaging member comprising a substrate, a charge generating layer disposed on the substrate, at least one charge transport layer disposed on the charge generating layer, and an anticurl back coating disposed on the substrate on a side opposite to the charge transport layer, the anticurl back coating comprising a first polymer, the first polymer being a low surface energy polymer comprising a polyalkyl siloxane-containing bisphenol A polycarbonate poly(4,4'-isopropylidene diphenyl carbonate) or a polyalkyl siloxane-containing bisphenol Z polycarbonate poly(4,4'-diphenyl-1,1'-cyclohexane carbonate), and a second polymer, the second polymer being a low surface energy polymer comprising a polyalkyl siloxane or a polyalkyl-polyaryl siloxane having a polycarbonate pendant group.

In an alternative embodiment, there is provided an imaging member comprising a substrate, a charge generating layer disposed on the substrate, at least one charge transport layer disposed on the charge generating layer, and an anticurl back coating disposed on the substrate on a side opposite to the charge transport layer, the anticurl back coating comprising a first polymer, the first polymer being a low surface energy polymer comprising a polyalkyl siloxane-containing bisphenol A polycarbonate poly(4,4'-isopropylidene diphenyl carbonate) or a polyalkyl siloxane-containing bisphenol Z polycarbonate poly(4,4'-diphenyl-1,1'-cyclohexane carbonate) and being selected from the group consisting of

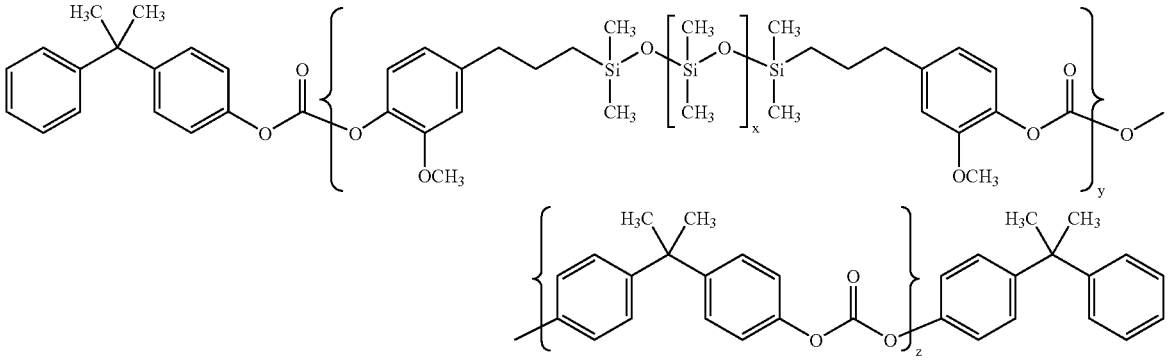

wherein x, y and z are integers representing a number of repeating units or a poly(4,4'-diphenyl-1,1'-cyclohexane carbonate), and

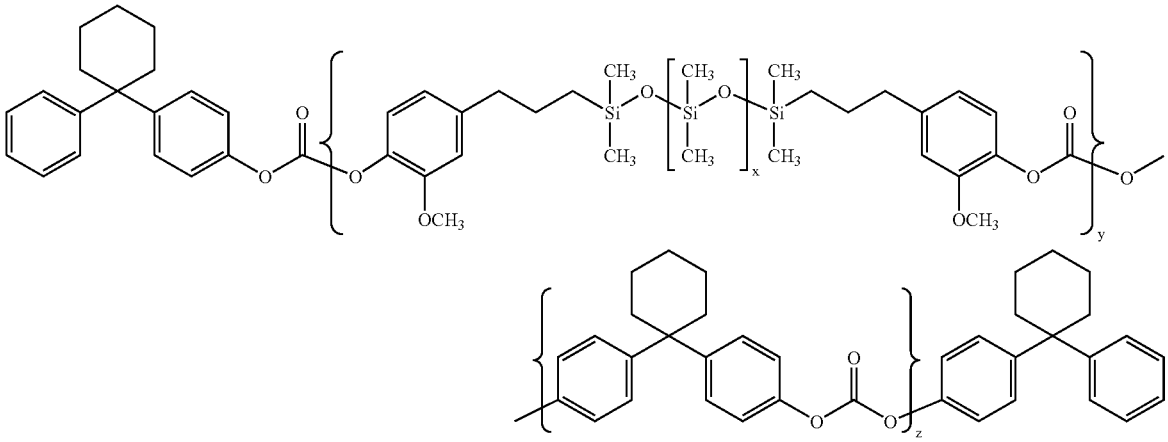

wherein x, y and z are integers representing a number of repeating units, and a second polymer, the second polymer being a low surface energy polymer comprising a polyalkyl siloxane or a polyalkyl-polyaryl siloxane having a polycarbonate pendant group and being selected from the group consisting of

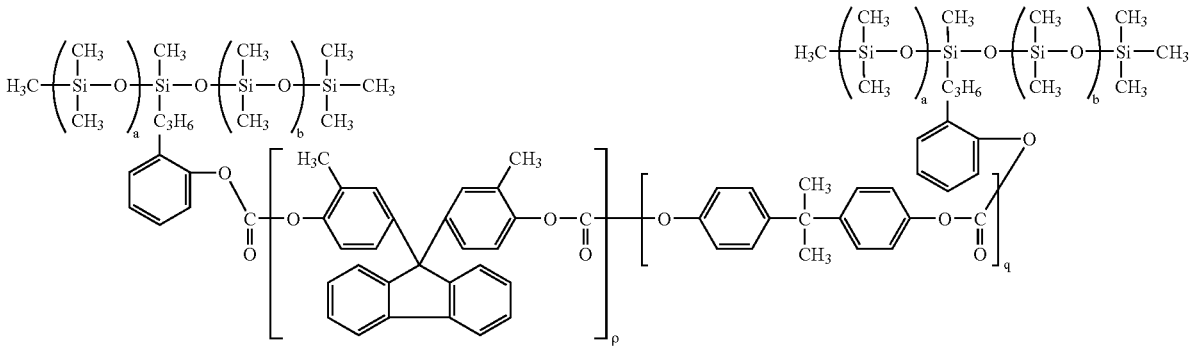

wherein a, b, p and q are integers representing a number of repeating units,
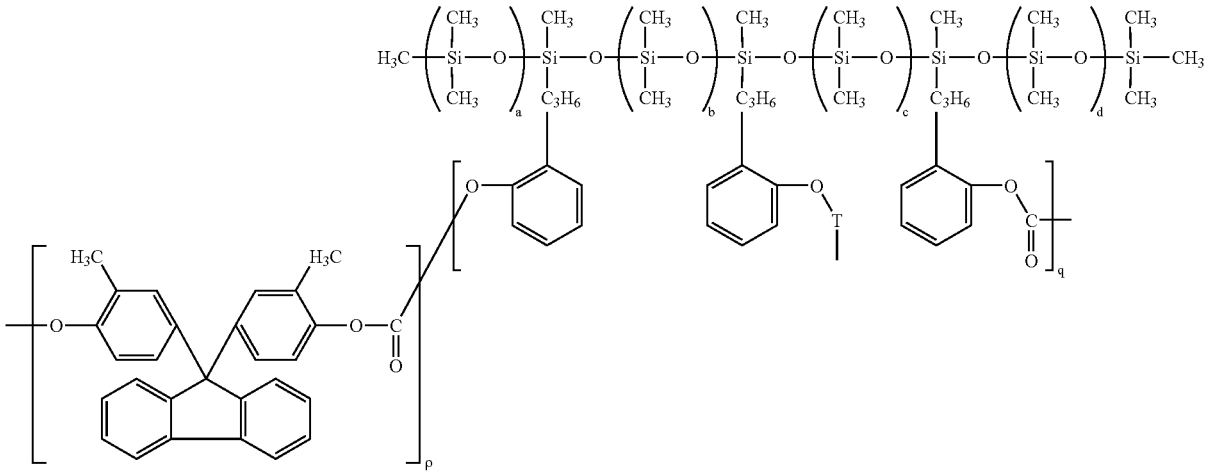
wherein a, b, c, d, p and q are integers representing a number of repeating units,
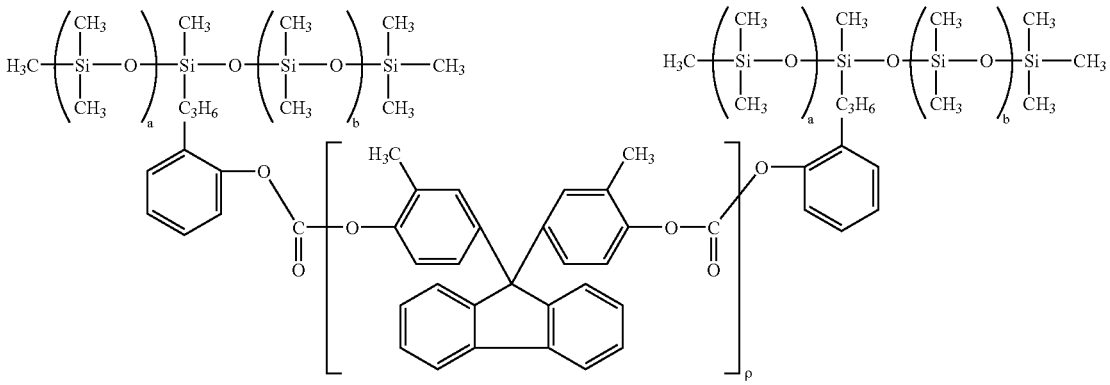
wherein a, b and p are integers representing the number of repeating units,
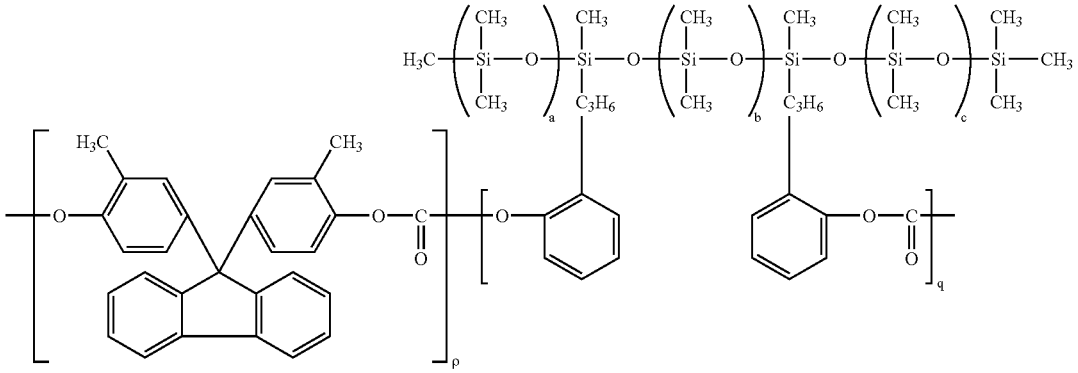

wherein a, b, c, p and q are integers representing the number of repeating units,

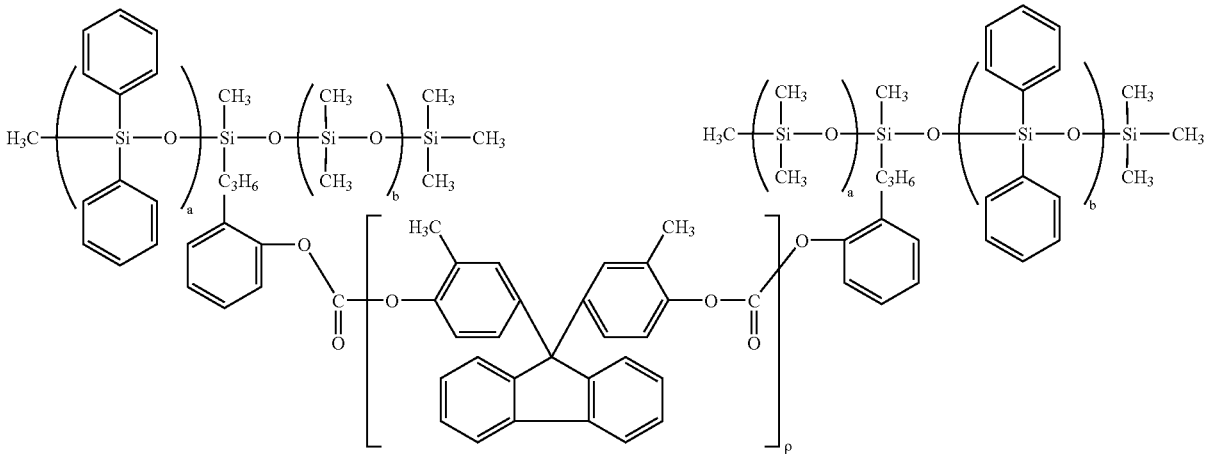

wherein the polymer has an polyalkyl and polyaryl siloxane main chain, and wherein a, b and p are integers representing the number of repeating units,

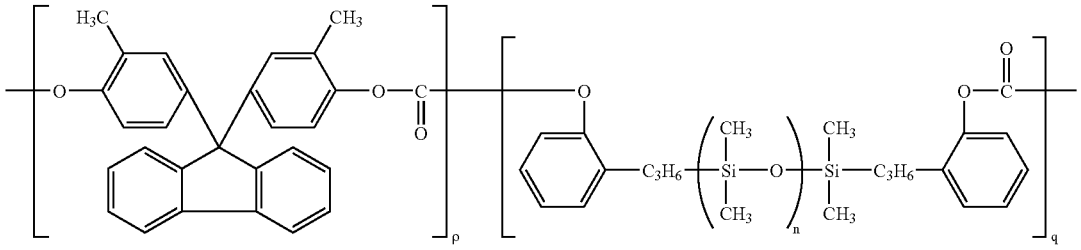

wherein a, p and q are integers representing the number of repeating units, and

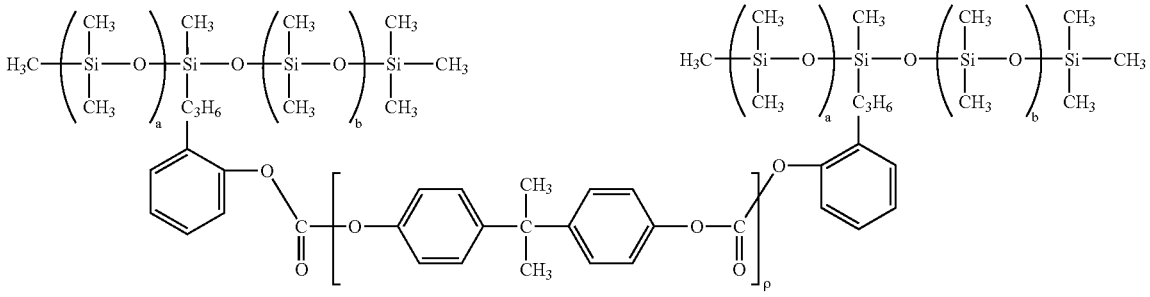

where a, b and p are integers representing the number of repeating units.

Another embodiment provides an image forming apparatus for forming images on a recording medium comprising an imaging member having a charge retentive surface for receiving an electrostatic latent image thereon, wherein the imaging member comprises a substrate, a charge generating layer disposed on the substrate, at least one charge transport layer disposed on the charge generating layer, and an anticurl back coating disposed on the substrate on a side opposite to the charge transport layer, the anticurl back coating comprising a first polymer, the first polymer being a low surface energy polymer comprising a polyalkyl siloxane-containing bisphenol A polycarbonate poly(4,4'-isopropylidene diphenyl carbonate) or a polyalkyl siloxane-containing bisphenol Z polycarbonate poly(4,4'-diphenyl-1,1'-cyclohexane carbonate), and a second polymer, the second polymer being a low surface energy polymer comprising a polyalkyl siloxane or a polyalkyl-polyaryl siloxane having a polycarbonate pendant group, a development component for applying a developer material to the charge-retentive surface, a transfer component for applying the developed image from the charge-retentive surface to a copy substrate, and a fusing component for fusing the developed image to the copy substrate.

BRIEF DESCRIPTION OF THE DRAWINGS

For a better understanding of the present embodiments, reference may be had to the accompanying figures.

DETAILED DESCRIPTION

In the following description, reference is made to the accompanying drawings, which form a part hereof and which illustrate several embodiments of the present embodiments. It is understood that other embodiments may be utilized and structural and operational changes may be made without departure from the scope of the present embodiments.

According to aspects illustrated herein, there is provided an anticurl back coating that addresses all the shortcomings of traditional anticurl back coating discussed above. The present application is related to commonly assigned U.S. Pat. No. 7,361,440 entitled "Anticurl Backing Layer for Electrostatographic Imaging Members," filed on Aug. 9, 2005, commonly assigned U.S. Pat. No. 7,422,831 entitled "Anticurl Back Coating Layer for Electrostatographic Imaging Members," filed on Sep. 15, 2005, and commonly assigned U.S. Patent Publication No. US 2007-0141493 A1 entitled "Imaging Member with Multilayer Anti-Curl Back Coating," filed on Dec. 21, 2005, all of which are herein incorporated by reference.

Figure 1:
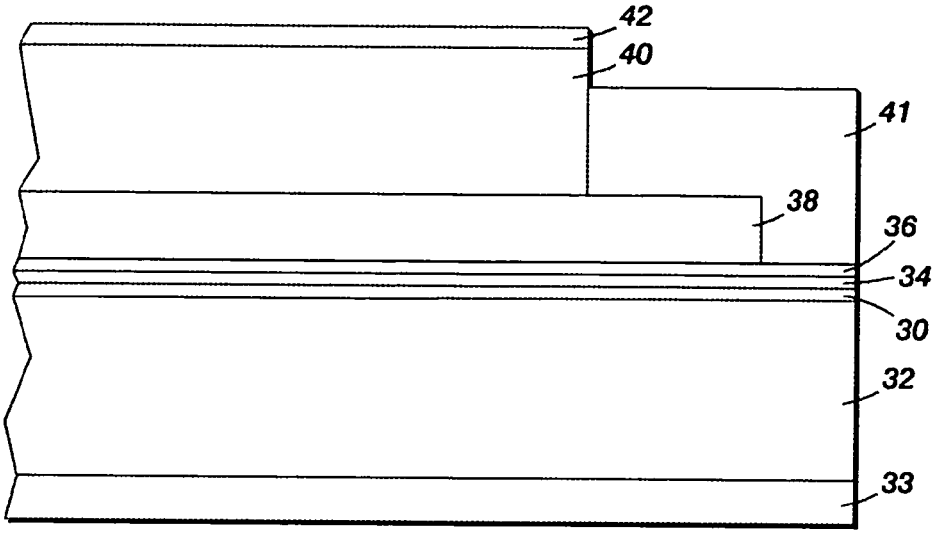
FIG. 1 is a cross-sectional view of a multilayered electrophotographic imaging member according to an embodiment of the present disclosure

An exemplary embodiment of the negatively charged flexible electrophotographic imaging member of the present disclosure is illustrated in FIG. 1. The substrate 32 has an optional electrical conductive layer 30. An optional hole blocking layer 34 can also be applied over the conductive layer, as well as an optional adhesive layer 36 over the hole blocking layer. The charge generating layer 38 is located between the adhesive layer 36 and the charge transport layer 40. An optional ground strip layer 41 operatively connects the charge generating layer 38 and the charge transport layer 40 to the conductive layer 30. An anticurl back coating layer 33 of the present disclosure is applied to the side of the substrate 32 opposite from the electrically active layers to render desired imaging member flatness. Other layer of the imaging member may also include, for example, an optional overcoat layer 42 directly over the charge transport layer 40 to provide protection against abrasion and wear.

The conductive ground plane 30 over the substrate 32 is typically a thin metallic layer, for example a 10 nanometer thick titanium coating, may be deposited over the substrate by vacuum deposition or sputtering process. The layers 34, 36, 38, 40 and 42 may be separately and sequentially deposited, on to the surface of conductive ground plane 30 of substrate 32, as wet coating layer of solutions comprising a solvent, with each layer being completely dried before deposition of the subsequent coating layer. The anticurl back coating 33 of the present disclosure is also solution coated, but is applied to the back side (the side opposite to all of the other layers) of substrate 32, to balance the curl and render imaging member flatness.

The Substrate

The photoreceptor support substrate 32 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate 32 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate 32 the substrate may have a number of many different configurations, such as, for example, a plate, a drum, a scroll, an endless flexible belt, and the like. In one embodiment, the substrate is in the form of a seamed flexible belt.

The thickness of the substrate 32 depends on numerous factors, including flexibility, mechanical performance, and economic considerations. The thickness of the support substrate 32 may range from about 50 micrometers to about 3,000 micrometers. In embodiments of flexible photoreceptor belt preparation, the thickness of substrate 32 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 32 is not soluble in any of the solvents used in each coating layer solution, is optically transparent, and is thermally stable up to a high temperature of about 150° C. A typical substrate support 32 used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Conductive Layer

The conductive ground plane layer 30 may vary in thickness depending on the optical transparency and flexibility desired for the electrophotographic imaging member. When a photoreceptor flexible belt is desired, the thickness of the conductive layer 30 on the support substrate 32, for example, a titanium and/or zirconium conductive layer produced by a sputtered deposition process, typically ranges from about 2 nanometers to about 75 nanometers to enable adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 30 comprising an electrically conductive material, such as titanium or titanium/zirconium, coating over the substrate layer 32.

The Hole Blocking Layer

A hole blocking layer 34 may then be applied to the substrate 32 or to the layer 30, where present. Any suitable positive charge (hole) blocking layer capable of forming an effective barrier to the injection of holes from the adjacent conductive layer 30 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl)gamma-aminopropyl trimethoxy silane, isopropyl 4-aminobenzene sulfonyl di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula $[H_2N(CH_2)_4]CH_3Si(OCH_3)_2$, and (gamma-aminopropyl)methyl diethoxysilane, which has the formula $[H_2N(CH_2)_3]CH_3Si(OCH_3)_2$, and combinations thereof, as disclosed, for example, in U.S. Pat. Nos. 4,338,387; 4,286,033; and 4,291,110, incorporated herein by reference in their entireties. An example of an embodiment of a hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 34 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 36 may be provided. In the embodiment illustrated in FIG. 1, an interface layer 36 is situated intermediate the blocking layer 34 and the charge generator layer 38. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 36 may be applied directly to the hole blocking layer 34. Thus, the adhesive interface layer 36 in embodiments is in direct contiguous contact with both the underlying hole blocking layer 34 and the overlying charge generator layer 38 to enhance adhesion bonding to provide linkage. In yet other embodiments, the adhesive interface layer 36 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 36 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 38 may thereafter be applied to the adhesive layer 36. Any suitable charge generating binder layer 38 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 38, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ400 (poly(4,4'-dihydroxy-diphenyl-1-1-cyclohexane) which has a molecular weight (MW) of 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 38 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The charge transport layer 40 is thereafter applied over the charge generating layer 38 and may include any suitable transparent organic polymer or non-polymeric material capable of supporting the injection of photogenerated holes or electrons from the charge generating layer 38 and capable of allowing the transport of these holes/electrons through the charge transport layer to selectively discharge the surface charge on the imaging member surface. In one embodiment, the charge transport layer 20 not only serves to transport holes, but also protects the charge generating layer 38 from abrasion or chemical attack and may therefore extend the service life of the imaging member. The charge transport layer 20 can be a substantially non-photoconductive material, but one which supports the injection of photogenerated holes from the charge generation layer 18. The layer 20 is normally transparent in a wavelength region in which the electrophotographic imaging member is to be used when exposure is effected therethrough to ensure that most of the incident radiation is utilized by the underlying charge generating layer 38. The charge transport layer should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate 32 and also a transparent conductive layer 30, image wise exposure or erase may be accomplished through the substrate 32 with all light passing through the back side of the substrate. In this case, the materials of the layer 40 need not transmit light in the wavelength region of use if the charge generating layer 38 is sandwiched between the substrate and the charge transport layer 40. The charge transport layer 40 in conjunction with the charge generating layer 38 is an insulator to the extent that an electrostatic charge placed on the charge transport layer is not conducted in the absence of illumination. The charge transport layer 40 should trap minimal charges as the charge pass through it during the printing process.

The charge transport layer 40 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 38 and capable of allowing the transport of these holes through the charge transport layer 40 in order to discharge the surface charge on the charge transport layer. The charge transport component typically comprises small molecules of an organic compound which cooperate to transport charge between molecules and ultimately to the surface of the charge transport layer.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the binder can be for example, from about 20,000 to about 1,500,000. One exemplary binder of this type is a MAKROLON binder, which is available from Bayer AG and comprises poly(4,4'-isopropylidene diphenyl) carbonate having a weight average molecular weight of about 120,000.

Exemplary charge transport components include aromatic polyamines, such as aryl diamines and aryl triamines. Exemplary aromatic diamines include N,N'-diphenyl-N,N'-bis (alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 40 may be, for example, at least about 5 weight % and may comprise up to about 60 weight %. The concentration or composition of the charge transport component may vary through layer 40, as disclosed, for example, in U.S. Pat. No. 7,033,714, filed Dec. 16, 2003, entitled "Imaging Members," by Anthony M. Horgan, et al. U.S. Pat. No. 6,933,089, filed Dec. 16, 2002, entitled "Imaging Members," by Anthony M. Horgan, et al.; and U.S. Pat. No. 7,018,756, filed Sep. 5, 2003, entitled "Dual charge transport layer and photoconductive imaging member including the same," by Damodar M. Pai, et al., the disclosures of which are incorporated herein by reference in their entireties.

In one exemplary embodiment, layer 40 comprises an average of about 10-60 weight % N,N'-diphenyl-N,N'-bis(3-methylphenyl)-1,1'-biphenyl-4,4'-diamine, such as from about 30-50 weight % N,N'-diphenyl-N,N'-bis(3-methylphenyl)-1,1'-biphenyl-4,4'-diamine.

The charge transport layer 40 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 40 to the charge generator layer 38 is maintained from about 2:1 to about 200:1 and in some instances as great as about 400:1.

Additional aspects relate to the inclusion in the charge transport layer 40 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. Pat. No. 7,018,256 incorporated by reference.

In one specific embodiment, the charge transport layer 40 is a solid solution including a charge transport component, such as N,N'-diphenyl-N,N'-bis(3-methylphenyl)-1,1'-biphenyl-4,4'-diamine, molecularly dissolved in a polycarbonate binder, the binder being either a poly(4,4'-isopropylidene diphenyl carbonate) or a poly(4,4'-diphenyl-1,1'-cyclohexane carbonate). The charge transport layer may have a Young's Modulus in the range of from about $2.5\times10^{-5}$ psi ($1.7\times10^{-4}$ Kg/cm$^2$) to about $4.5\times10^{-5}$ psi ($3.2\times10^{-4}$ Kg/cm$^2$) and a thermal contraction coefficient of between about $6\times10^{-5}$/° C. and about $8\times10^{-5}$/° C.

The thickness of the charge transport layer 40 can be from about 5 micrometers to about 200 micrometers, e.g., from between about 15 micrometers and about 40 micrometers. The charge transport layer may comprise dual layers or multiple layers with different concentration of charge transporting components.

In embodiments, the charge transport layer 40, may also contain inorganic or organic fillers to impart further wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement.

Figure 2:
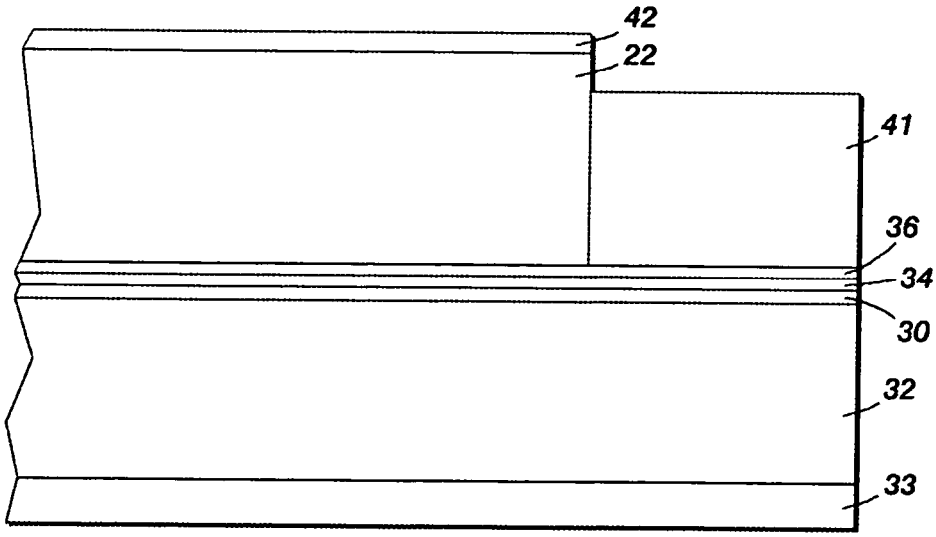
FIG. 2 is a cross-sectional view of a structurally simplified multilayered electrophotographic imaging member according to another embodiment of the present disclosure.

As an alternative to the use of two discretely separated, charge transport layer 40 and charge generation layer 38, a single imaging layer 22 having both charge generating and charge transporting capability may be employed in place of the two separate layers, as shown in FIG. 2, with other layers of the imaging member being formed as described above. The imaging layer 22 may comprise a single electrophotographically active layer capable of retaining an electrostatic charge in the dark during electrostatic charging, imagewise exposure and image development, as disclosed, for example, in U.S. Pat. No. 6,756,169, filed Jul. 23, 2002, entitled "Imaging Members," by Liang-Bih Lin, et al. The single imaging layer 22 may include charge transport molecules in a binder, similar to those of the charge transport layer 40 and optionally may also include a photogenerating/photoconductive material, similar to those of the layer 38 described above.

The Ground Strip Layer

Other layers such as conventional ground strip layer 41 including, for example, conductive particles dispersed in a film forming binder may be applied to one edge of the imaging member to promote electrical continuity with the conductive layer 30 through the hole blocking layer 34. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

Optionally, an overcoat layer 42, if desired, may also be utilized to provide imaging member surface protection as well as improve resistance to abrasion.

The Charge Transport Layer and the Overcoat Layer

Additional aspects relate to the inclusion of nano particle dispersion, such as silica, metal oxides, ACUMIST (waxy polyethylene particles), PTFE, and the like, in the material matrix of the charge transport layer or an optional overcoat layer 42, if used, to impart abrasion/wear resistance enhancement. The nano particle dispersion may also provide the charge transport layer 40 or the overcoat with effective contact friction reduction. The particle dispersion concentrated in the transport layer 40 can be up to about 10 weight percent of the weight based on the total weight of the charge transport layer 40 to provide optimum wear resistance without causing a deleterious impact on the electrical properties of the fabricated imaging member. In the event that an overcoat layer 42 is employed, it may comprise a similar polymer binder used for the charge transport layer or a different one, and be from about 1 to about 5 microns in thickness.

Since the charge transport layer 40 can have a substantial thermal contraction mismatch compared to that of the substrate support 32, the prepared flexible electrophotographic imaging member does always exhibit spontaneous upward curling due to the result of larger dimensional contraction in the charge transport layer 40 than the substrate support 32, as the solution applied wet charge transport coating is dried at elevated temperature, followed by subsequently cooling down from high temperature to reach its Tg, and then finally to room ambient temperature. An anti-curl back coating 33 of present disclosure can be applied to the back side of the substrate support 32 (which is the side opposite the side bearing the electrically active coating layers) in order to thereby render the prepared imaging member with desired flatness.

The Anticurl Back Coating

Generally, the conventional anticurl back coating comprises a film forming thermoplastic polymer; it is typically a bisphenol A polycarbonate and an adhesion promoter dissolved in a solvent and then applied onto the reverse side of the active photoreceptor. The anticurl back coating must adhere well to the substrate 32, for example polyethylenenaphthalate (KADELEX) substrate, of the imaging member, for the entire duration of the functional life of the imaging member belt, while being subjected to xerographic imaging process and cycling motion over each of the belt support module rollers and the backer bars within the copier or printer.

Bisphenol A is a chemical building block primarily used to make polycarbonate plastic and epoxy resins. A bisphenol A polycarbonate polymer is poly(4,4'-isopropylidene diphenyl carbonate), available as MAKROLON from Bayer Corp. (Wilmington, Mass.) and is the film forming polymeric material used in conventional anticurl back coating formulation.

The molecular structure of MAKROLON, having a weight average molecular weight of about 130,000, is given in Formula (I) below:

Formula (I)

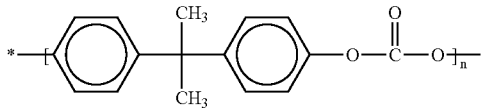

where n indicates the degree of polymerization. In the alternative, poly(4,4'-diphenyl-1,1'-cyclohexane carbonate) may also be used to for the anticurl back coating in place of MAKROLON. The molecular structure of poly(4,4'-diphenyl-1,1'-cyclohexane carbonate), having a weight average molecular weight of about between about 20,000 and about 200,000, is given in Formula (II) below:

Formula (II)

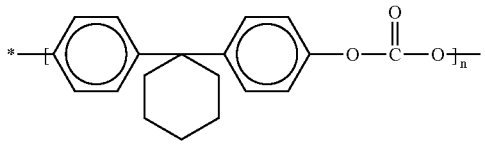

where n indicates the degree of polymerization.

In a conventional anticurl back coating, an adhesion promoter of copolyester is included in its material matrix to provide adhesion bonding enhancement to the substrate support. Satisfactory adhesion promoter content is from about 0.2 percent to about 20 percent or from about 2 percent to about 10 percent by weight, based on the total weight of the anticurl back coating The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. A solvent such as methylene chloride may be used in embodiments. The anticurl back coating has a thickness of from about 5 micrometers to about 50 micrometers, or from about 10 micrometers to about 20 micrometers, in further embodiments. A generic or conventional anticurl back coating formulation is a 92:8 ratio of polymer to adhesive dissolved at 9 percent by weight in a solvent. Specifically, the formulation may be 92:8 ratio of MAKROLON polymer to VITEL PE2200 adhesive. The film forming polymer and adhesive promoter may be dissolved at 9 percent by weight in a solvent of methylene chloride.

In one embodiment of the present disclosure, the conventional anticurl back coating is replaced by the presently disclosed layer that may be formulated to comprise entirely of polymer blending of two alternate low surface energy polymers without the need to add an adhesion promoter; the innovative anticurl back coating 33 thus created is found to have reasonably good adhesion to the KADELEX substrate support 32. The novel anticurl back coating thus formed from polymer blending of two low surface energy polymers is comprised of (1) a modified Bisphenol A polycarbonate poly (4,4'-isopropylidene diphenyl carbonate) to contain small amounts of a polyalkyl siloxane, for example PDMS, present in the polycarbonate chain backbone and (2) a second low surface energy polymer selected from a PDMS containing poly carbonate pendant group in its molecular structure. The resulting anticurl back coating does have effectual surface energy reduction and surface lubricity that are adjustable, as compared to conventional anticurl back coatings, to meet in any specific machine functional requirement. The first low surface energy bisphenol A modified polycarbonate, having a weight average molecular weight of approximately 25,000, is commercially available as LEXAN EXL 1414-T from GE Plastics Canada, Ltd (Mississauga, ONTL5N 5P2) and described in U.S. Pat. No. 6,072,011, which is hereby incorporated by reference; nevertheless, a high molecular weight of up to 150,000 is an example of an anticurl back coating polymer blending. Because this PDMS-containing bisphenol A polycarbonate polymer, LEXAN EXL 1414-T, contains only very small fractions of surface energy lowering PDMS segments in its polymer chain backbone to render a coating layer with lowered surface energy and lubricity effects, it has a molecular structure substantially identical to that of MAKROLON shown in Formula (I). The molecular structure of LEXAN EXL 1414-T is provided below Formula (III):

Formula (III)

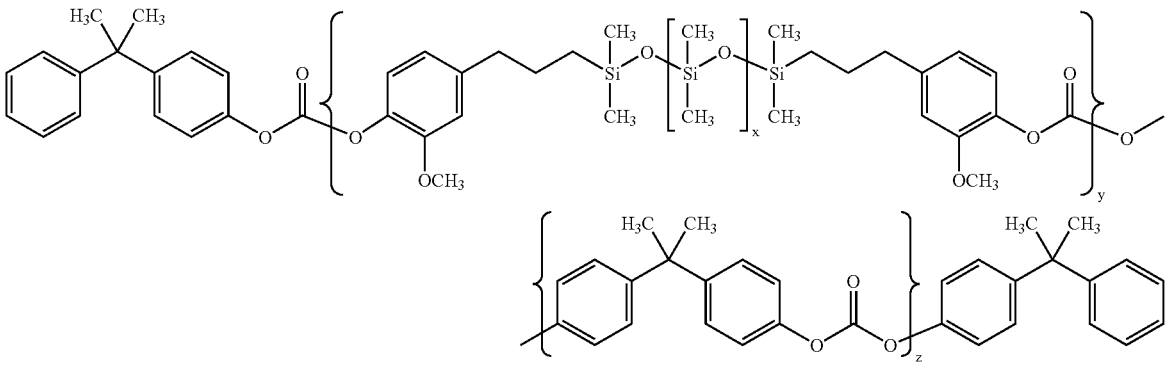

where x, y, and z are integers representing the number of repeating units.

Alternatively, a similar low surface energy film forming polycarbonate that is modified from formula (III) may also be considered an alternate candidate for presently disclosed anticurl back coating polymer blend formulation. The molecular structure of this modified polycarbonate is provided below in Formula (IV):

Formula (IV)

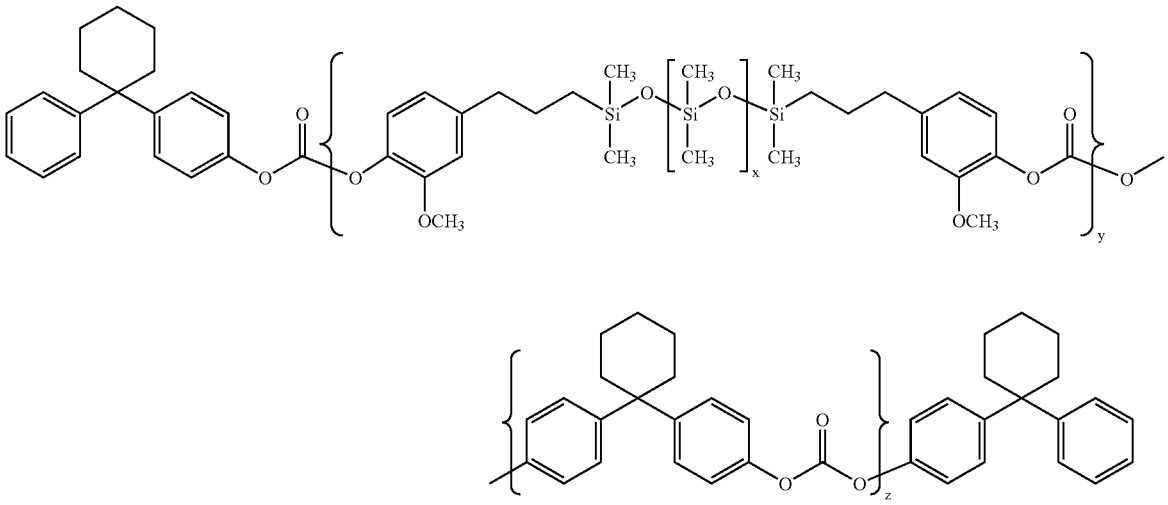

where x, y and z are integers representing the number of repeating units.

Because both of the above two low surface energy polycarbonates have extremely low surface energy, when either one is used to formed an anticurl back coating, the resulting anticurl back coating is found to be too slippery to provide adequate frictional interaction with the drive-roll to effect proper belt drive. In some instances, total drive-roll slippage occurs during photoreceptor belt machine imaging function.

The second low surface energy polymer that is selected for present anticurl back coating polymer blending is a polysiloxane that contains poly carbonate pendant groups in its molecular structure. The molecular structure of the second low surface energy polymer for use in the anticurl back coating polymer blending may be selected from either of Formula (V) through Formula (XI). The molecular structure of the low surface energy polymer of Formula (V) is provided below:

Formula (V)

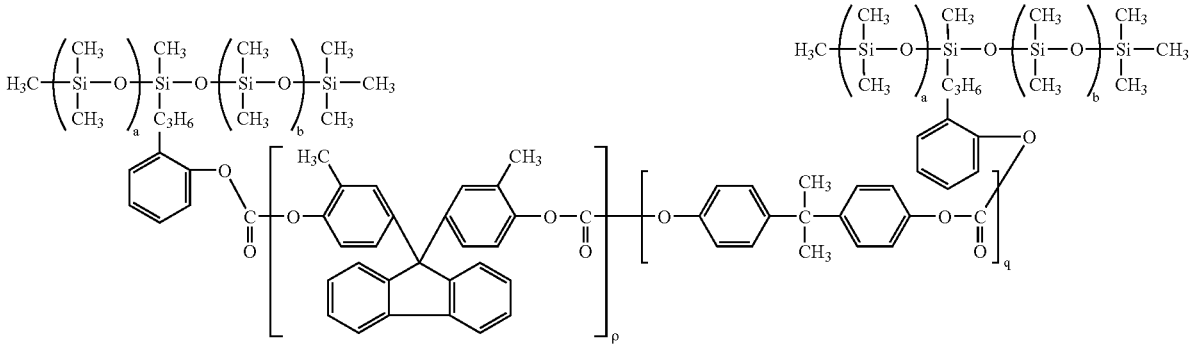

where a, b, p and q are integers representing the number of repeating units. The molecular structure of the low surface energy polymer of Formula (VI) is provided below:

Formula (VI)

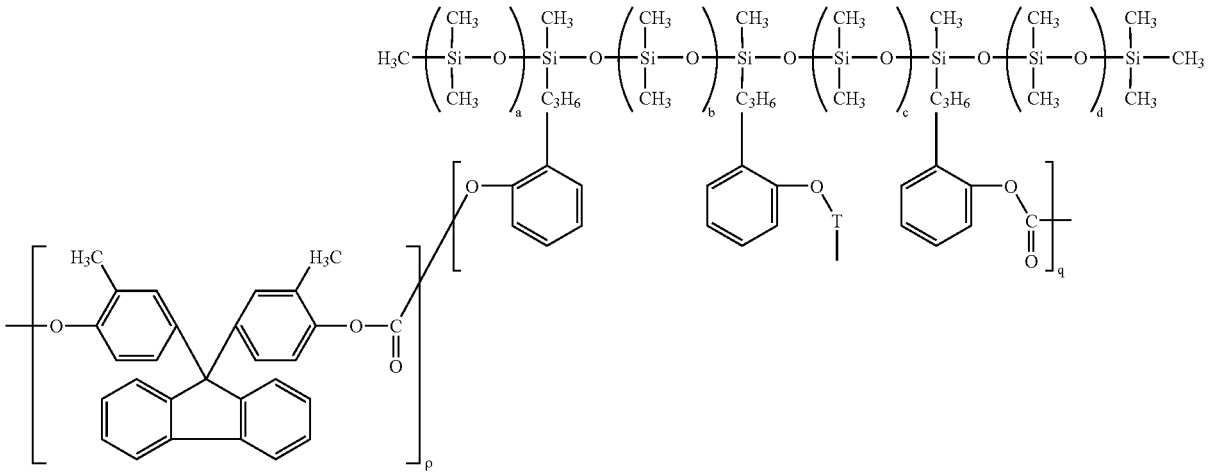

where a, b, c, d, p and q are integers representing the number of repeating units.

The molecular structure of the low surface energy polymer of Formula (VII) is provided below:

Formula (VII)

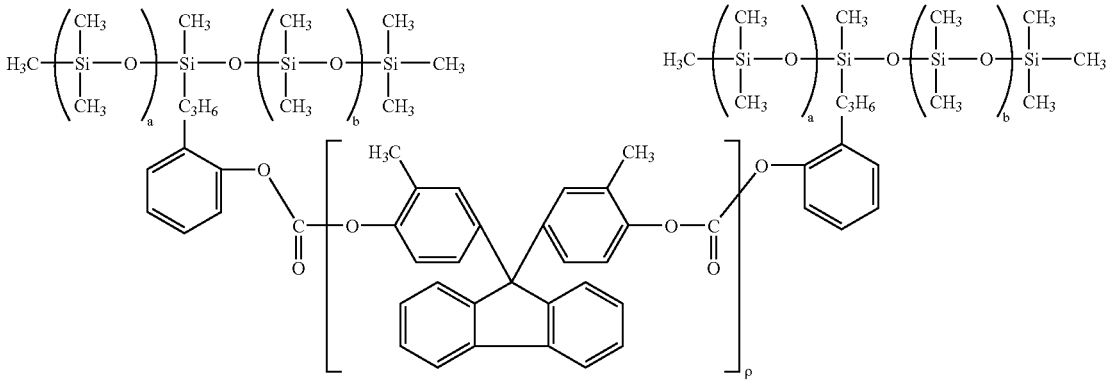

where a, b and p are integers representing the number of repeating units.

The molecular structure of the low surface energy polymer of Formula (VIII) is provided below:

Formula (VIII)

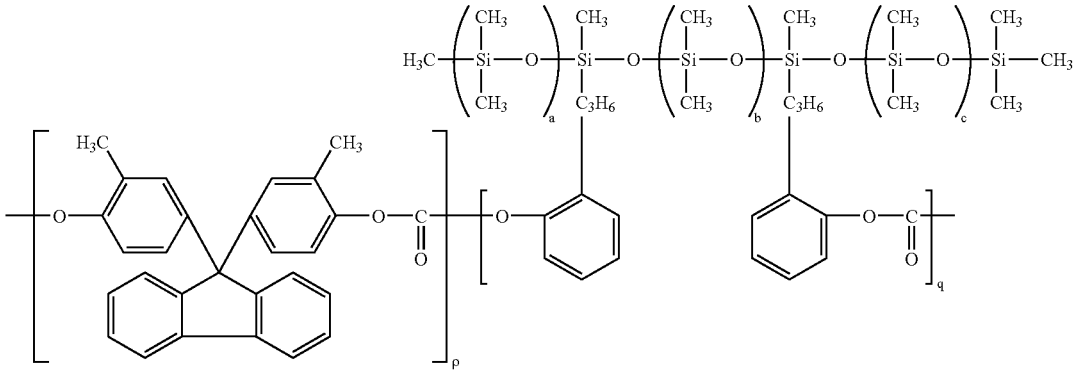

where a, b, c, p and q are integers representing the number of repeating units.

The molecular structure of the low surface energy polymer of Formula (IX) is provided below:

Formula (IX)

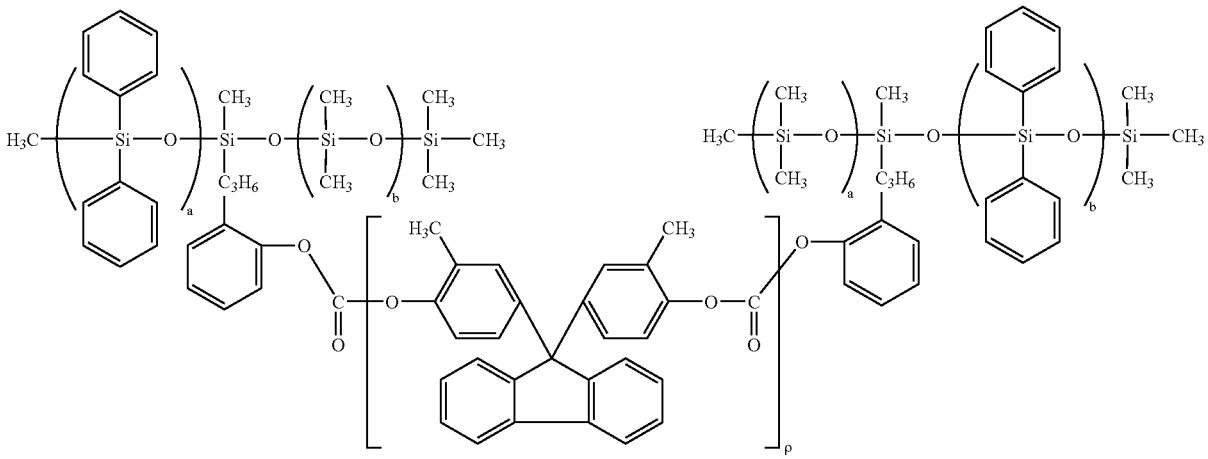

where the polymer has a polyalkyl and polyaryl siloxane main chain, and wherein a, b and p are integers representing the number of repeating units.

The molecular structure of the low surface energy polymer of Formula (X) is provided below:

Formula (X)

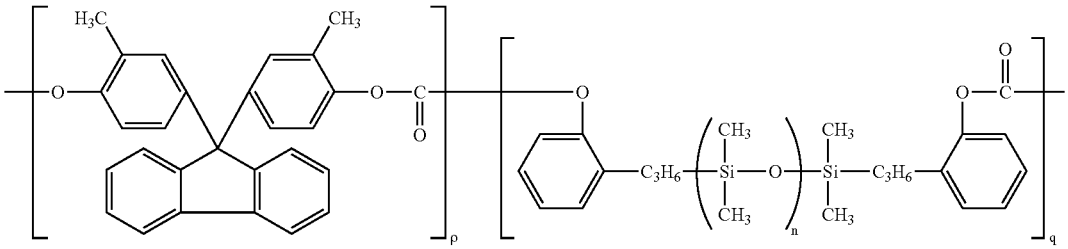

where a, p and q are integers representing the number of repeating units.

The molecular structure of the low surface energy polymer of Formula (XI) is provided below:

Formula (XI)

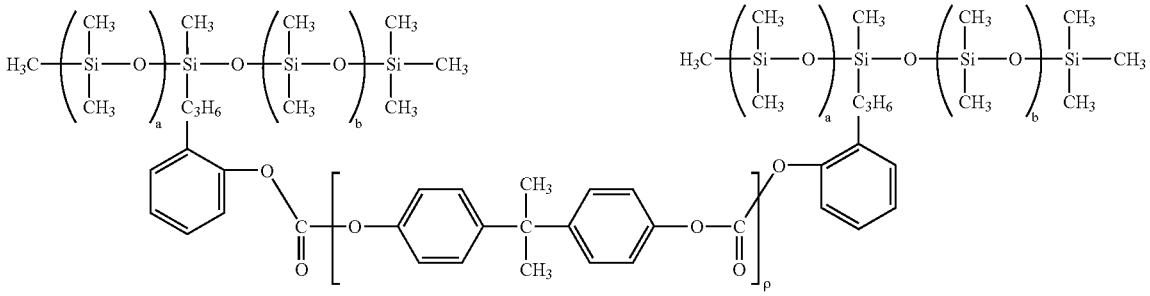

where a, b and p are integers representing the number of repeating units.

The second low surface energy polymer that fits the molecular structure description in Formulas (V) through (XI) above may commercially be available as FPC0540UA, FPC0550UA, FPC0580UA, and FPC0170UA from Mitsubishi Gas Chemical Corporation (Tokyo, Japan) and are described in U.S. Pat. No. 6,630,562, which is hereby incorporated by reference. In one experimental study, photoreceptor belts prepared to have only MGC4 polymer anticurl back coating have not been found to adequately impart abrasion/wear resistance nor absolute electrostatic charge elimination. This is due to the fact that the anticurl back coating formulated to have only this second polymer does not provide low surface energy that is low enough to impart adequate surface slipperiness for effective problem resolution.

The LEXAN EXL 1414-T has physical/mechanical/thermal properties (Tg of 150° C., a coefficient of thermal expansion of $6.6\times10^{-6}$/° C., Young's Modulus of $3.2\times10^{5}$ psi, and is readily soluble in methylene chloride or other conventional organic solvents for ease of coating solution preparation) that are equal to those of MAKROLON; furthermore, the physical/mechanical/thermal properties of the second low surface energy polymer of any of the above are also determined to be similar to those of MAKROLON. Therefore, the mixing of these two types of low surface energy polymers can be conveniently used to create a customized polymer blend for an anticurl back coating formulation, replacing MAKROLON. Because both types of these polymers are different in surface energy, they can be formulated at any mixing proportion to adjust or yield a suitable surface lubricity that meets specific machine functioning requirement.

In alternative embodiments of the present disclosure, the anticurl back coating is formulated with polymer blending of the two selected low surface energy polymers plus an adhesive promoter. In the present disclosure, the MAKROLON in the anticurl back coating will be substituted with a low surface energy polymer blend, such as for example, LEXAN EXL 1414-T and FPC0170UA. In other embodiments, the adhesive promoter is present in an amount of from about 0.2% to about 30% by weight of the total weight of the anticurl back coating.

For reasons of convenience, the present embodiments will be described only for electrophotographic imaging members in flexible belt form even though the present disclosure is applicable to electrostatographic imaging members having similar configurations.

Eletrophotographic flexible belt imaging members are well known in the art. Typically, a flexible substrate is provided having an electrically conductive surface. For negatively charged electrophotographic imaging members, at least one photoconductive layer is applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto an adhesive layer, if present, or directly over the blocking layer, and a charge transport layer is subsequently formed on the charge generation layer. The substrate contains an anticurl back coating on the side opposite from the side bearing the electrically active layer.

In the present disclosure, polymer candidates with different degrees of lower surface energy than those currently used in anticurl back coatings (e.g., bisphenol A polycarbonate polymers such as, for example, MAKROLON) are blended to adequately reduce and tune its surface contact friction that provide abrasion/wear resistance enhancement and effective suppression of electrostatic charge build-up problem when photoreceptor belts function in the larger printing apparatuses. The use of such a polymer blend will thereby eliminate the need for the use of PTFE dispersion in anticurl back coating formulations and assure proper belt drive capacity free of the drive-roll slippage problem. In the larger printing apparatuses, the use of such a low surface energy polymer blend will further remove the need for additional components, and resolve the anticurl back coating associated problems/issues to extend the functional life of the imaging member belt, thereby subsequently reducing the manufacturing cost of the imaging member belts.

The polymer commonly used in the art is a bisphenol A based polymer. Embodiments for the preparation of an anticurl back coating of the present disclosure include blending a bisphenol A polycarbonate-based polymer of Formula (III) or bisphenol Z polycarbonate-based polymer of Formula (IV) with a second low surface energy polycarbonate selected from one of Formulas (V) through (XI) to form the anticurl back coating. Since a coating layer formed with using a first low surface energy polymer of either Formula (III) or (IV) is much more slippery than the coating layer counterpart made with a second low surface energy polymer of Formulas (V) through (XI), the polymer blend of the first polymer and the second polymer of the presently disclosed anticurl back coating is therefore created to comprise from about 99:1 to about 1:99 weight ratio of the first polymer to second polymer for adjusting the surface properties of the anticurl back coating that meets any specific machine's need. However, the polymer may also be formed in the range of from about 35:65 to about 65:35.

The PDMS-containing bisphenol A polycarbonate is the first low surface energy polymer obtained from General Electric Co. as LEXAN EXL 1414-T which contains only very small fractions of surface energy lowering PDMS segments in its polymer chain backbone. In alternative embodiments, other siloxane-containing polycarbonates from the LEXAN EXL series may be used. In other embodiments, the siloxane is present in an amount of from about 2% to about 8% by weight of the total weight of the polymer. Alternatively, the first low surface energy polymers for use are modified Bisphenol A polycarbonate of poly(4,4'-isopropylidene diphenyl carbonate) to give a bisphenol Z polycarbonate of poly(4,4'-isopropylidene diphenyl carbonate) containing of from about 2% to about 10% by weight of siloxane segments in the polymer chain. The low surface energy copolymers obtained from Mitsubishi Gas Chemical Corporation (Tokyo, Japan, referred to as FPC0540UA, FPC0550UA, FPC0580UA, and FPC0170UA) are used as second low surface energy polymer for anticurl back coating blending and have molecular weights of from about 30,000 to about 80,000.

All of these low surface energy polymers used for polymer blending contain fractions of polysiloxane segments which are present in either the polymer chain backbone or as pendant groups, as well bisphenol A polycarbonate or polycarbonate linkage in the molecular structure. They have a weight average molecular weight ranging from about 20,000 to about 200,000, or from about 25,000 to about 150,000 for ease of solution preparation consideration. The anticurl back coating formulated according to present disclosure exhibits surface adhesiveness, less surface energy and lower surface contact friction than those polymeric materials used in forming the traditional anticurl back coatings.

The viscosity of an anticurl coating solution prepared by polymer blending of the low surface energy polymers (with or without incorporation of an adhesive promoter) are in the range of from about 20 to about 900 centipoise (cp) when dissolved in a solvent, such as methylene chloride, to give a solution where the content of polymers is between about 10 to about 15 weight percent of the total weight of the solution. While the viscosity of the coating solution is dependent on molecular weight of the polymer, it can also be conveniently adjusted by either changing the concentration of polymer dissolved in the solution or using other solvents Viscosity of the polymer solution may impact the particular method of extrusion coating the anticurl back coating onto the photoreceptor. Coating defects caused from using low viscosity solutions include Maragoni Cells, mottle, runback, streaks, non-uniform thickness across the width of the web, and the like.

The anticurl back coating of this disclosure is applied to the rear side of the substrate to provide imaging member flatness. Any suitable and conventional technique may be utilized to mix and thereafter apply the anticurl back coating mixture onto the supporting substrate layer. Typical application techniques include, for example extrusion coating, draw bar coating, roll coating, wire wound rod coating, and the like. The anticurl back coating may be formed in a single coating step or in multiple coating steps.

Drying of the deposited anticurl back coating may be effected by any suitable conventional technique such as oven drying, infra red radiation drying, air drying and the like. The thickness of the anti-curl layer after drying depends on the degree of photoconductive imaging member curling caused by the charge transport layer. The thickness is from about 5 micrometers to about 50 micrometers, or from about 10 to about 20 micrometers.

For the preparation of flexible electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts of this disclosure may be used for other purposes where cycling durability is important.

The process of this disclosure for fabricating the flexible electrophotographic imaging member webs described above and in the Examples below comprises providing a substrate layer having a first side and a second side, and at least a first parallel side and a second parallel side. The substrate may further include a conducting layer. The process includes forming at least one imaging layer on the first side of the substrate, and forming a low surface energy anticurl back coating on the second side of the substrate. The embodiments of the anticurl back coating include a polymer blend of two low surface energy modified polycarbonate polymers containing PDMS and bisphenol A polycarbonate. The polymer blend may also further include an optional adhesion promoter. The adhesion promoter may be a copolyester, VITEL PE2200, and the like. The anticurl back coating may be formed by extrusion of a solution of anticurl coating material through a single die nozzle onto the second major side of the substrate layer. Additionally, there may also be included steps for forming an optional overcoat layer on the at least one imaging layer, as well as for forming an optional ground strip layer on the at least one imaging layer.

The flexible multilayered electrophotographic imaging member web stocks fabricated in accordance with the embodiments described herein may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

The prepared flexible imaging belt may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

A prepared electrophotographic imaging member belt can be evaluated by printing in a marking engine into which the belt, formed according to the exemplary embodiment, has been installed. For intrinsic electrical properties it can also be determined by conventional electrical drum scanners. Additionally, the assessment of its propensity of developing charge deficient spots (CDS) defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference.

All the patents and applications referred to herein are hereby specifically, and totally incorporated herein by reference in their entirety in the instant specification.

EXAMPLES

The examples set forth hereinbelow are illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Preparation of Imaging Member

A conventional electrophotographic imaging member was prepared by providing a 0.02 micrometer thick titanium layer coated on a biaxially oriented polyethylene naphthalate substrate (PEN, KALEDEX 2000) having a thickness of 3.5 mils (0.09 millimeters). Applied thereon with a gravure applicator, was a solution containing 50 grams 3-amino-propyltriethoxysilane, 41.2 grams water, 15 grams acetic acid, 684.3 grams of 200 proof denatured alcohol and 200 grams heptane. This layer was then dried for about 2 minutes at 120° C. in the forced air drier of the coater. The resulting blocking layer had a dry thickness of 500 Angstroms.

An adhesive layer was then prepared by applying a wet coating over the blocking layer, using a gravure applicator, containing 0.2 weight percent of polyarylate adhesive (ARDEL D100 available from Toyota Hsutsu Inc.) in a 60:30:10 volume ratio mixture of tetrahydrofuran/monochlorobenzene/methylene chloride. The adhesive layer was then dried for about 2 minutes at 120° C. in the forced air dryer of the coater. The resulting adhesive layer had a dry thickness of 200 Angstroms.

A photogenerating layer dispersion was prepared by introducing 0.45 grams of LUPILON200 (PC-Z 200) available from Mitsubishi Gas Chemical Corp and 50 ml of tetrahydrofuran into a 100 gm glass bottle. To this solution was added 2.4 grams of hydroxygallium phthalocyanine and 300 grams of ⅛ inch (3.2 millimeter) diameter stainless steel shot. This mixture was then placed on a ball mill for 8 hours. Subsequently, 2.25 grams of PC-Z 200 was dissolved in 46.1 gm of tetrahydrofuran, and added to this OHGaPc slurry. This slurry was then placed on a shaker for 10 minutes. The resulting slurry was, thereafter, applied to the adhesive interface with a Bird applicator to form a charge generation layer having a wet thickness of 0.25 mil (about 6 microns). A strip about 10 mm wide along one edge of the substrate web bearing the blocking layer and the adhesive layer, was deliberately left uncoated to facilitate adequate electrical contact by the ground strip layer that was to be applied later. The charge generation layer was dried at 120° C. for 1 minute in a forced air oven to form a dry charge generation layer having a thickness of 0.4 micrometers.

This coated web stock was simultaneously coated over with a charge transport layer and a ground strip layer by co-extrusion of the coating materials. The charge transport layer was prepared by combining MAKROLON 5705, a Bisphenol A polycarbonate thermoplastic having a molecular weight of about 120,000, commercially available from Farbensabricken Bayer A. G., with a charge transport compound N,N'-diphenyl-N,N'-bis(3-methylphenyl)-[1,1'-biphenyl]-4,4'-diamine in an amber glass bottle in a weight ratio of 1:1 (or 50 weight percent of each).

The resulting mixture was dissolved to give 15 percent by weight solid in methylene chloride. This solution was applied on the charge generating layer by extrusion to form a coating which upon drying in a forced air oven gave a charge transport layer 29 micrometers thick.

The strip, about 10 millimeters wide, of the adhesive layer left uncoated by the charge generating layer, was coated with a ground strip layer during the co-extrusion process. The ground strip layer coating mixture was prepared by combining 23.81 grams of polycarbonate resin (MAKROLON 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the charge transport layer and the ground strip. At this point, the imaging member, having a 29-micrometer thick dried charge transport layer, spontaneously exhibited upward curling into a 1.5-inch tube when unrestrained.

An anti-curl coating was prepared by combining 88.2 grams of polycarbonate resin (MAKROLON 5705), 7.12 grams VITEL PE-2200 copolyester (available from Bostik, Inc. Middleton, Mass.) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and charge transport layer) of the electrophotographic imaging member web by extrusion coating and dried to a maximum temperature of 125° C. in a forced air oven for 3 minutes to produce a dried anti-curl backing layer having a thickness of 17 micrometers and flatten the imaging member.

Control Example

A conventional anticurl back coating solution was prepared, to contain 8% by weight of VITEL PE-2200 adhesion promoter in 92% by weight of MAKROLON 5705 (based only on the total weight of these solids) dissolved in merthylene chloride, using the standard anticurl back coating solution preparation method according to the procedures and using exact same materials described in the above Imaging Member Preparation Example. The prepared anticurl back coating solution was then applied over a 3.5-mil KADALEX substrate surface and dried at elevated temperature, by following standard hand coating process in the lab, to give a conventional 17-micrometer dried anticurl back coating. The KADALEX substrate having the coated anticurl back coating layer showed the typical anticurling characteristic and was to be used to served as a control.

Disclosure Example I

An anticurl back coating, according to an embodiment, was prepared and coated onto a 3.5-mil PEN, KALEDEX substrate surface by following the same hand coating procedures described in Control Example above to give an anticurl back coating, except that the MAKROLON was replaced with an alternate PDMS-containing bisphenol A polycarbonate LEXAN EXL1414-T, having a molecular weight of about 25,000, to provide surface energy reduction and lubricity effects.

LEXAN EXL 1414-T is a commercially available film forming polymer of modified bisphenol A polycarbonate, like MAKROLON, but to contain of from about 2% to about 10% by weight of random blocking of PDMS segments in the polymer chain backbone. LEXAN EXL 1414-T can be obtained from GE Plastic Ltd (Mississauga, ONT). Testing demonstrated a reduced surface energy of 21 dynes/cm in the PDMS-containing bisphenol A polycarbonate polymer for the anticurl back coating of the Disclosure Example in comparison to 37 dynes/cm obtained for the control anticurl back coating of the Control Example. Likewise, the coefficient of sliding contact friction measurements, carried out by dragging the surface of each anticurl back coating against the top of a smooth metal stainless steel plate gave coefficient of friction of 0.31 for the PDMS-containing bisphenol A polycarbonate polymer as compared to 0.48 for the control anticurl back coating. The selection of LEXAN EXL 1414-T as a candidate for the present disclosure anticurl back coating formulation was based on the facts that it had: (a) Mechanical/physical/thermal properties (a Tg of 150° C., a coefficient of thermal expansion/contraction of $6.6\times10^{-6}$/° C., and a Young's Modulus of $3.2\times10^{5}$ psi) equal to those of MAKROLON; (b) Good solubility in methylene chloride and other conventional organic solvents for ease of coating solution preparation; (c) A molecular structure substantial identical to that of MAKROLON; and (d) very importantly, an inherent surface energy lowering PDMS fraction in the polymer chain back bone. Thus, the disclosure anticurl back coating prepared using the PDMS-containing polymer not only could provide equal counter-curling capability to impart imaging member flatness for direct MAKROLON replacement, it did also give effectual surface lubricity to ease surface sliding contact friction reduction to minimize/suppress, abrasion, wear, and electrostatic charge buildup problems. Additionally, adhesion bond strength of the disclosure anticurl back coating to the KADELEX substrate was practically equivalent to that of the control anticurl back coating counterpart.

Disclosure Example II

An anticurl back coating, according to an embodiment, was prepared and coated onto a 3.5-mil PEN, KALEDEX substrate surface by following the same hand coating procedures as described in Control Example above to give an anticurl back coating, except that the MAKROLON was replaced with another PDMS-containing bisphenol A polycarbonate (FPC0170UA, available from Mitsubishi Gas Chemical Corporation (Tokyo, Japan) having a molecular weight of about 70,000, to provide the anticurl back coating with surface energy reduction and lubricity effects. The anticurl back coating prepared not only did provide equal counter-curling capability as that of the control to impart imaging member flatness, it also adhered strongly to the PEN substrate.

Disclosure Example III

An anticurl back coating, according to an embodiment, was prepared and coated onto a 3.5-mil PEN, KALEDEX substrate surface by following the same hand coating procedures as described in Control Example above to give an anticurl back coating, except that the MAKROLON was replaced with an anticurl back coating comprising a weight ration of 50:50 LEXAN EXL 1414-T: FPC0170UA to provide the prepared anticurl back coating with surface energy reduction and lubricity effects. The anticurl back coating did provide imaging member with desired flatness and bonded well to the PEN substrate.

Mechanical/Physical Properties Asessment

The anticurl back coatings (ACBC) of Control Example and Disclosure Examples I, II, and III were determined for each respective surface energy surface contact friction, and the surface adhesiveness. The surface energy was evaluated by liquid contact angle measurement method, while the surface contact friction determination was carried out by sliding the anticurl back coating surface against a stainless steel surface. For surface adhesiveness assessment, a 3M masking tape was stick to each anticurl back coating surface and the adhesive tape was then 180° peeled-off to give the peel strength. The measurement outcome are presented in Table 1 below:

TABLE 1

| ACBC SAMPLE IDENTIFICATION | Surface Energy (dynes/cm) | Coefficient of Friction | 180° Peel Strength (gms/cm) |
|---|---|---|---|
| Std Control | 40 | 0.49 | 248 |
| Lexan 1414-T | 21 | 0.31 | 36 |
| FPC0170UA | 32 | 0.40 | 150 |
| 50:50 Blend | 27 | 0.35 | 62 |

The data listed in above table show that the ACBC formulated with LEXAN EXL 1414-T had the lowest surface energy, lowest coefficient of surface contact friction, and least 180° peeled tape off strength among all of the four ACBCs test samples. These results indicate that ACBC created by only using LEXAN EXL 1414-T is the most lubricated and most slippery coating that may cause a photoreceptor belt to exhibit belt slippage problem, under a normal machine operation condition, as a result of drive-roll spinning due to excessive ACBC slipperiness. However, a polymer blend of LEXAN EXL and FPC0170UA could give an ACBC the benefit of adjustable surface properties which are easily customized or adjusted to fit any specific machine functioning need to resolve abrasion/wear and electrostatic build-up problems.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate;

a charge generating layer disposed on the substrate;

at least one charge transport layer disposed on the charge generating layer; and an anticurl back coating disposed on the substrate on a side opposite to the charge transport layer, the anticurl back coating comprising a first polymer, the first polymer being a low surface energy polymer comprising a polyalkyl siloxane-containing poly(4,4'-isopropylidene diphenyl carbonate) or a polyalkyl siloxane-containing poly(4,4'-diphenyl-1,1'-cyclohexane carbonate), and a second polymer, the second polymer being a low surface energy polymer comprising a polyalkyl siloxane or a polyalkyl-polyaryl siloxane having a polycarbonate pendant group.

2. The imaging member of claim 1, wherein the first polymer is selected from the group consisting of
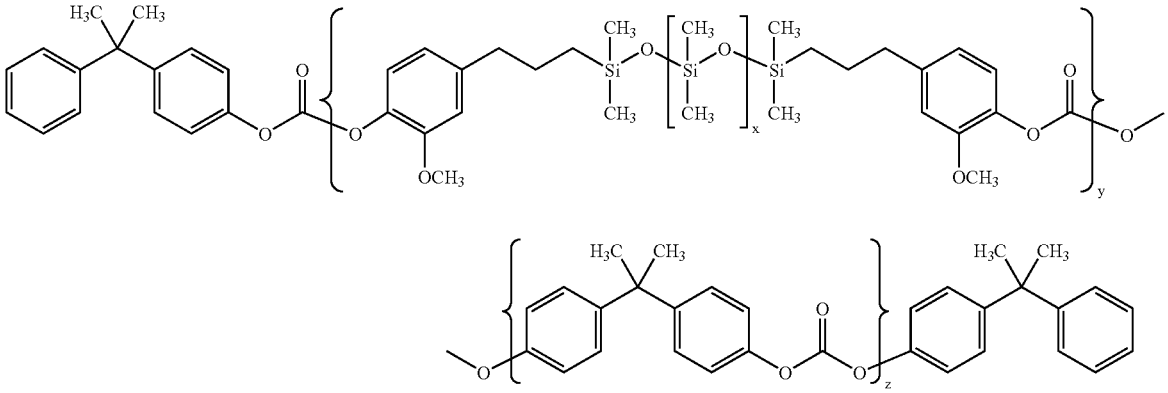
wherein x, y and z are integers representing a number of repeating units or a poly(4,4'-diphenyl-1,1'-cyclohexane carbonate), and
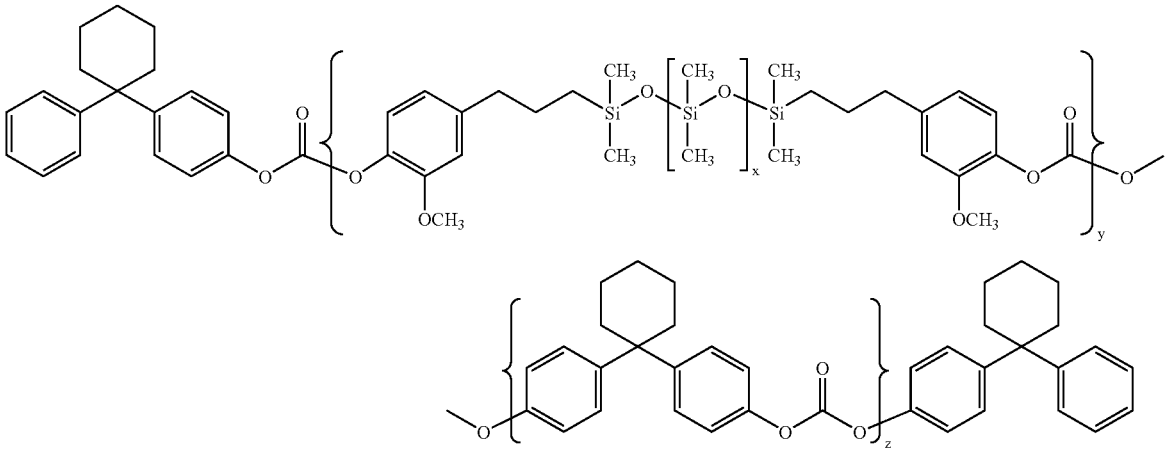
wherein x, y and z are integers representing a number of repeating units, and the second polymer is selected from the group consisting of
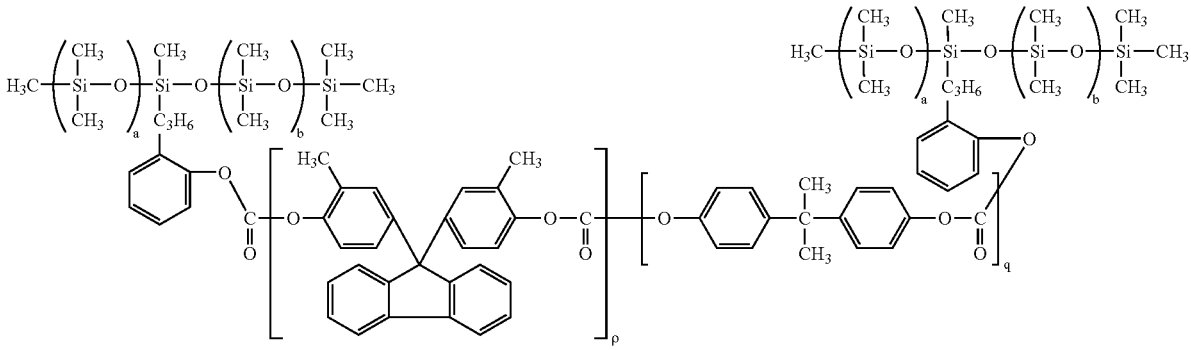

wherein a, b, p and q are integers representing a number of repeating units,
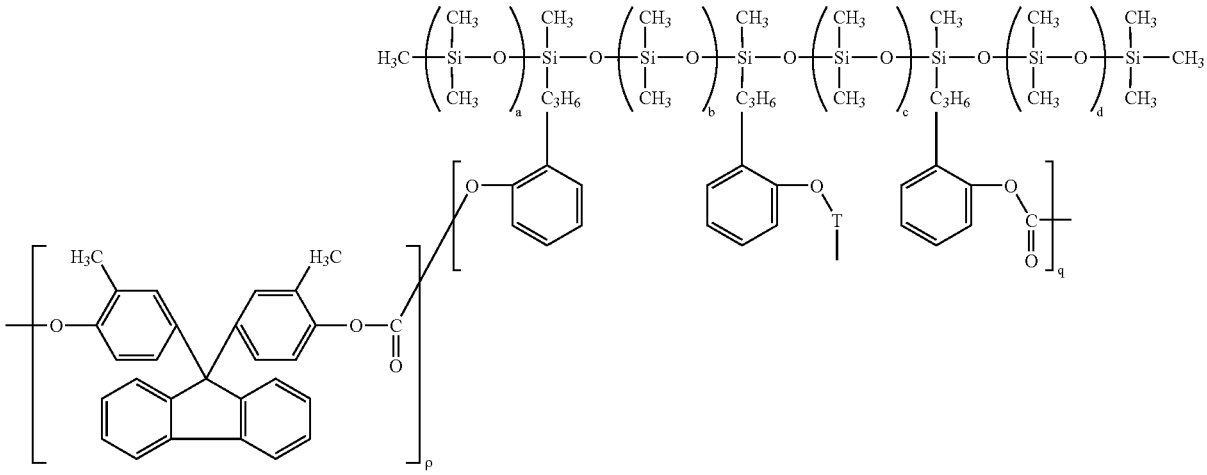
wherein a, b, c, d, p and q are integers representing a number of repeating units,
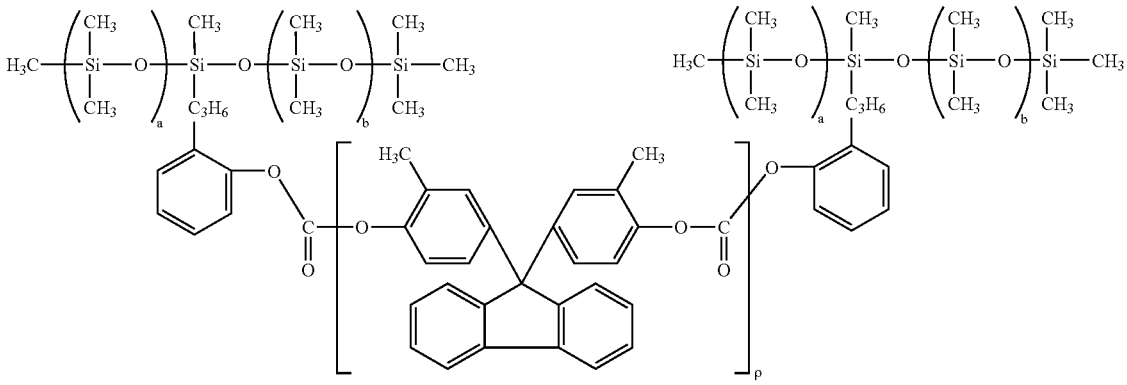
wherein a, b and p are integers representing the number of repeating units,
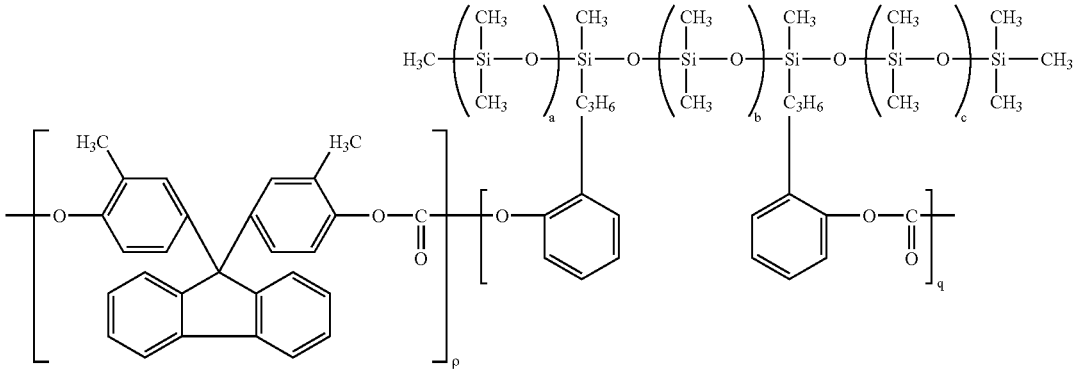

wherein a, b, c, p and q are integers representing the number of repeating units,

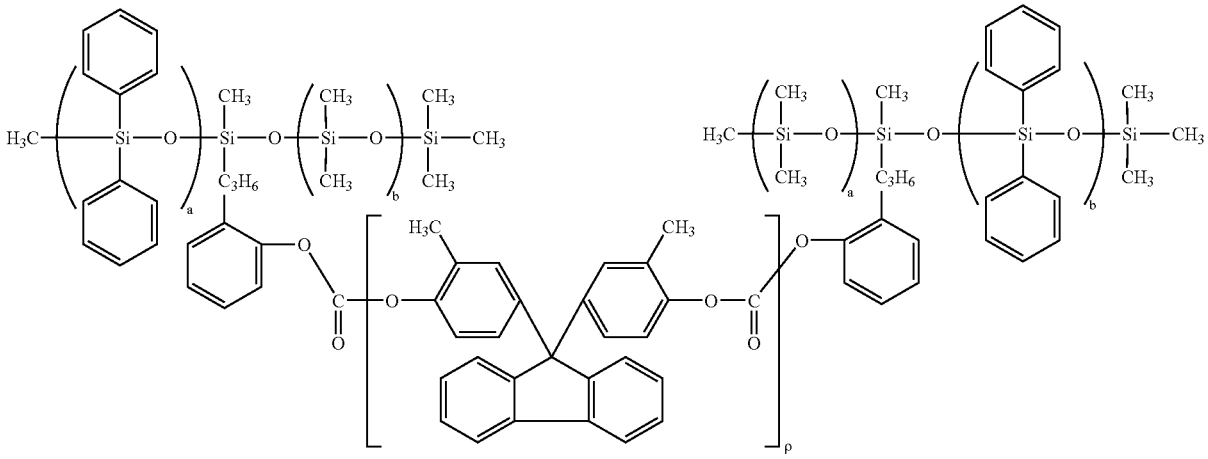

wherein the polymer has an polyalkyl and polyaryl siloxane main chain, and wherein a, b and p are integers representing the number of repeating units,

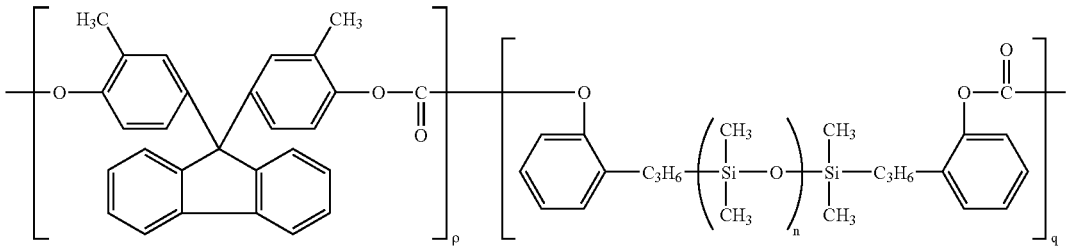

wherein a, p and q are integers representing the number of repeating units, and

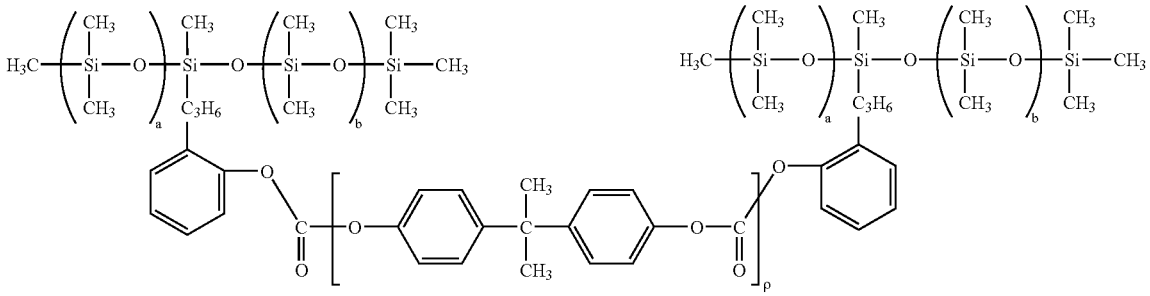

where a, b and p are integers representing the number of repeating units.

3. The imaging member of claim 1, wherein the polyalkyl siloxane in the first polymer is polydimethyl siloxane.

4. The imaging member of claim 1, wherein the first polymer and the second polymer are present in the anticurl back coating from about 99:1 to about 1:99 by weight ratio of the first polymer to the second polymer.

5. The imaging member of claim 4, wherein the first polymer and the second polymer are present in the anticurl back coating from about 35:65 to about 65:35 by weight ratio of the first polymer to the second polymer.

6. The imaging member of claim 1, wherein the anticurl back coating further includes an adhesion promoter.

7. The imaging member of claim 6, wherein the adhesion promoter is a copolyester.

8. The imaging member of claim 6, wherein the adhesion promoter is present in the anticurl back coating in an amount of from about 0.2 percent to about 30 percent by weight.

9. The imaging member of claim 1, wherein the anticurl back coating has a thickness of from about 5 micrometers to about 50 micrometers.

10. The imaging member of claim 9, wherein the anticurl back coating has a thickness of from about 10 micrometers to about 20 micrometers.

11. The imaging member of claim 1, wherein the first polymer and the second polymer have a weight average molecular weight of from about 20,000 to about 200,000.

12. The imaging member of claim 11, wherein the first polymer and the second polymer have a weight average molecular weight of from about 25,000 to about 150,000.

13. An imaging member comprising:

a substrate;

a charge generating layer disposed on the substrate;

at least one charge transport layer disposed on the charge generating layer; and an anticurl back coating disposed on the substrate on a side opposite to the charge transport layer, the anticurl back coating comprising a first polymer, the first polymer being a low surface energy polymer comprising a polyalkyl siloxane-containing poly(4,4'-isopropylidene diphenyl carbonate) or a polyalkyl siloxane-containing poly(4,4'-diphenyl-1,1'-cyclohexane carbonate) and being selected from the group consisting of

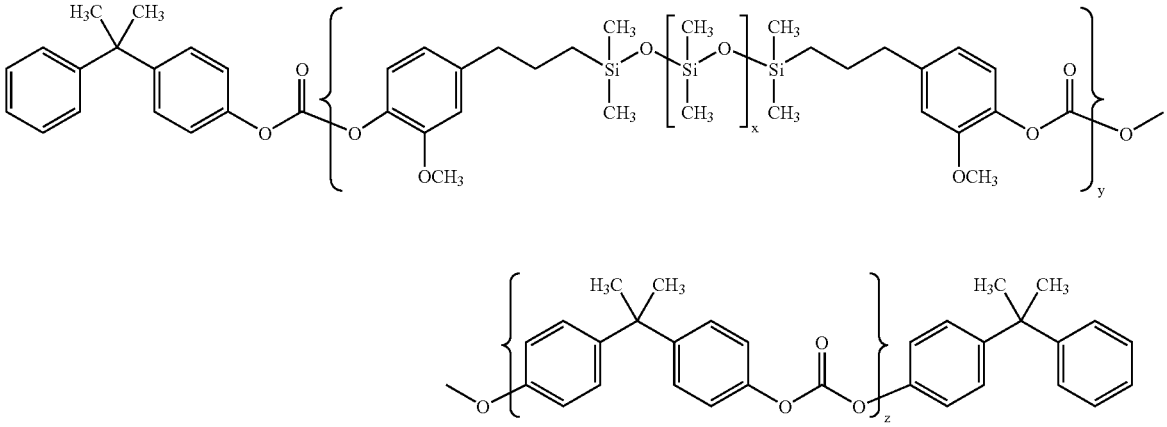

wherein x, y and z are integers representing a number of repeating units or a poly(4,4'-diphenyl-1,1'-cyclohexane carbonate), and

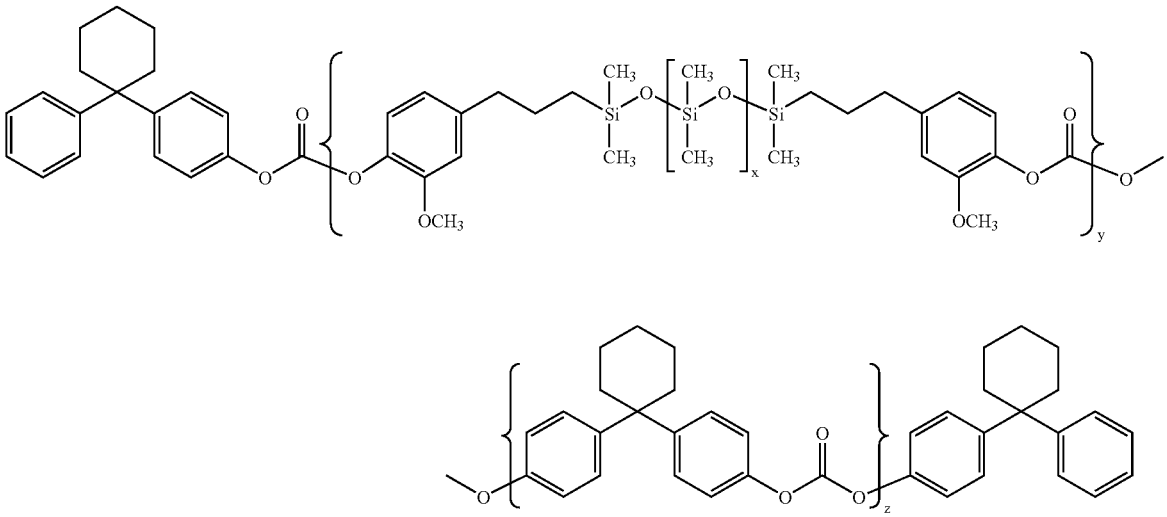

wherein x, y and z are integers representing a number of repeating units, and a second polymer, the second polymer being a low surface energy polymer comprising a polyalkyl siloxane or a polyalkyl-polyaryl siloxane having a polycarbonate pendant group and being selected from the group consisting of

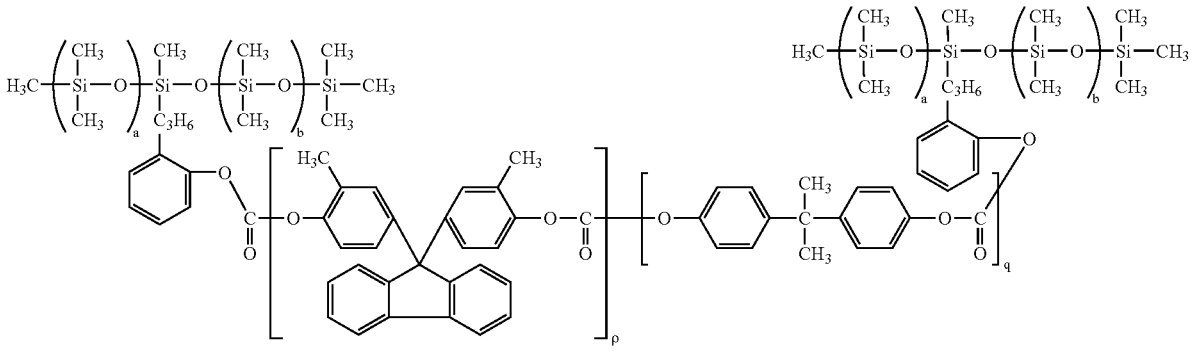

wherein a, b, p and q are integers representing a number of repeating units,

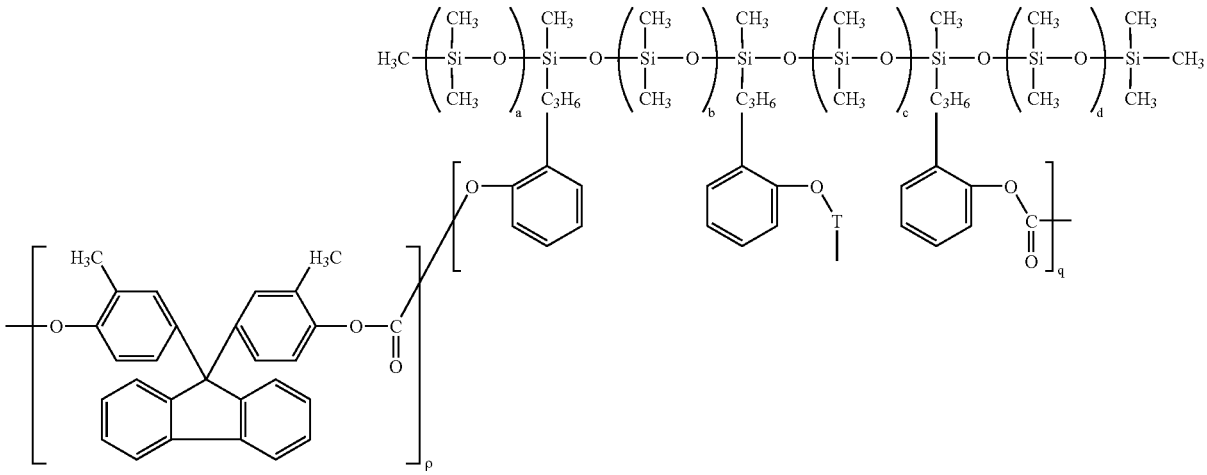

wherein a, b, c, d, p and q are integers representing a number of repeating units,

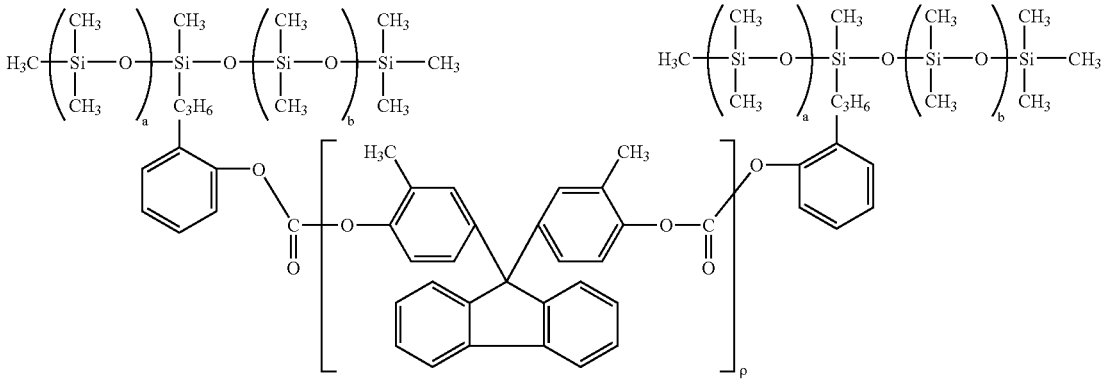

wherein a, b and p are integers representing the number of repeating units,
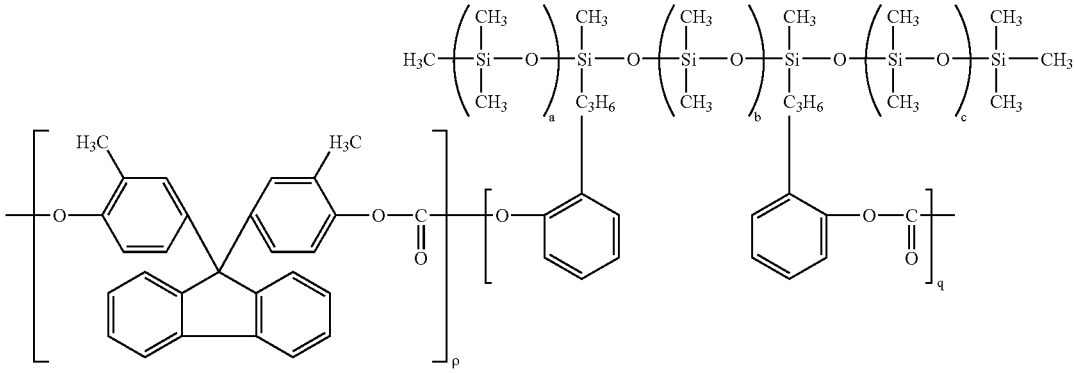
wherein a, b, c, p and q are integers representing the number of repeating units,
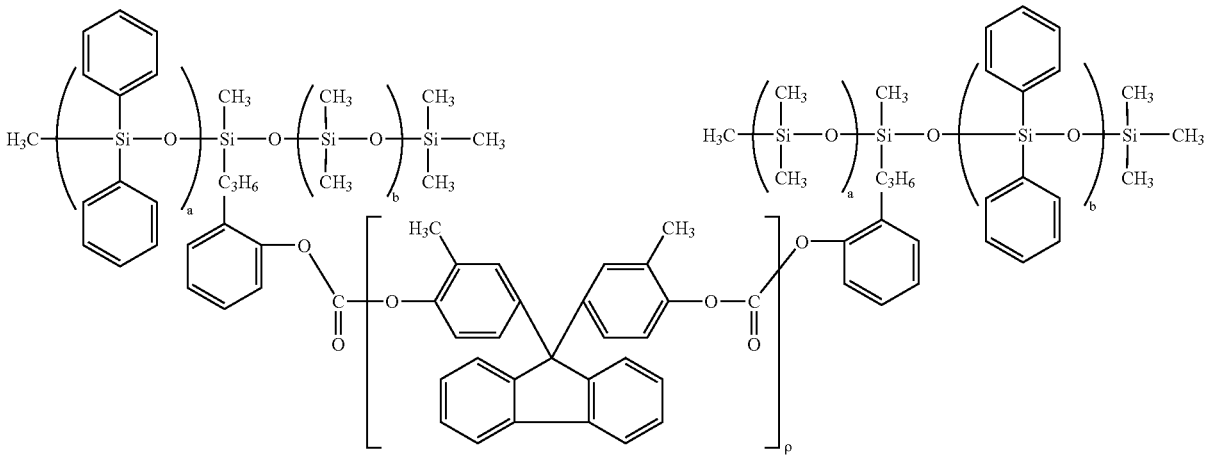
wherein the polymer has an polyalkyl and polyaryl siloxane main chain, and wherein a, b and p are integers representing the number of repeating units,
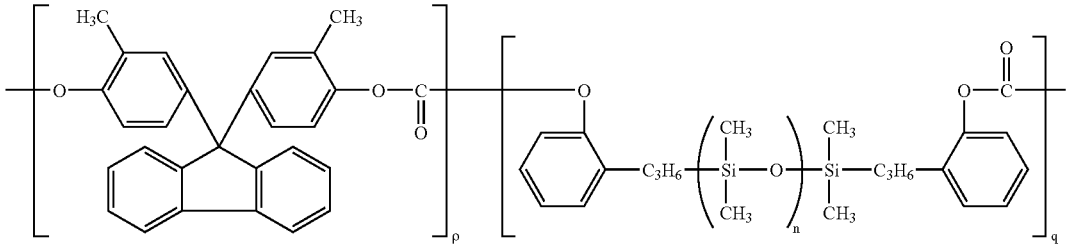

wherein a, p and q are integers representing the number of repeating units, and

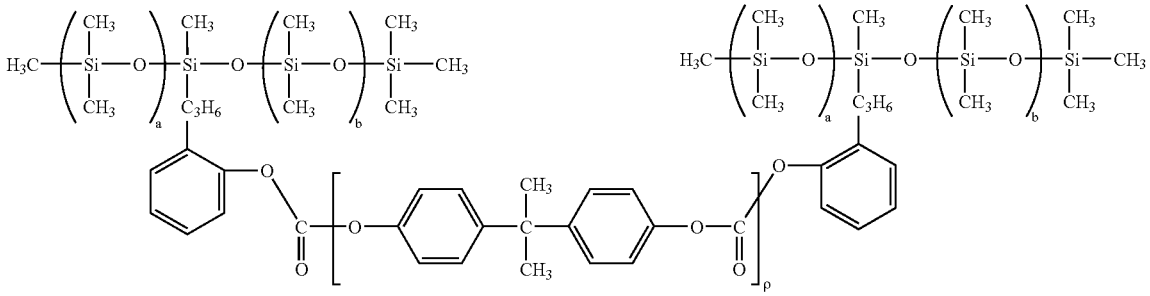

where a, b and p are integers representing the number of repeating units.

14. An image forming apparatus for forming images on a recording medium comprising:

an imaging member having a charge retentive surface for receiving an electrostatic latent image thereon, wherein the imaging member comprises a substrate, a charge generating layer disposed on the substrate, at least one charge transport layer disposed on the charge generating layer, and an anticurl back coating disposed on the substrate on a side opposite to the charge transport layer, the anticurl back coating comprising a first polymer, the first polymer being a low surface energy polymer comprising a polyalkyl siloxane-containing poly(4,4'-isopropylidene diphenyl carbonate) or a polyalkyl siloxane-containing poly(4,4'-diphenyl-1,1'-cyclohexane carbonate), and a second polymer, the second polymer being a low surface energy polymer comprising a polyalkyl siloxane or a polyalkyl-polyaryl siloxane having a polycarbonate pendant group;

a development component for applying a developer material to the charge-retentive surface;

a transfer component for applying the developed image from the charge-retentive surface to a copy substrate; and a fusing component for fusing the developed image to the copy substrate.

15. The image forming apparatus of claim 14, wherein the first polymer is selected from the group consisting of

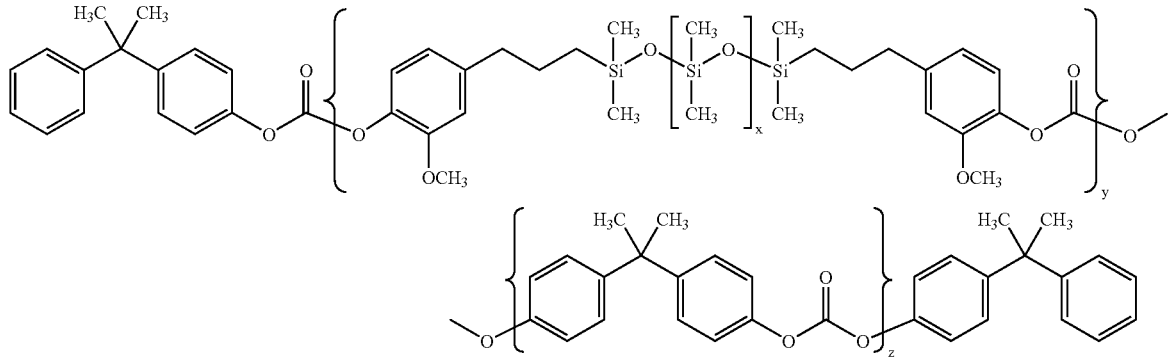

wherein x, y and z are integers representing a number of repeating units or a poly(4,4'-diphenyl-1,1'-cyclohexane carbonate), and

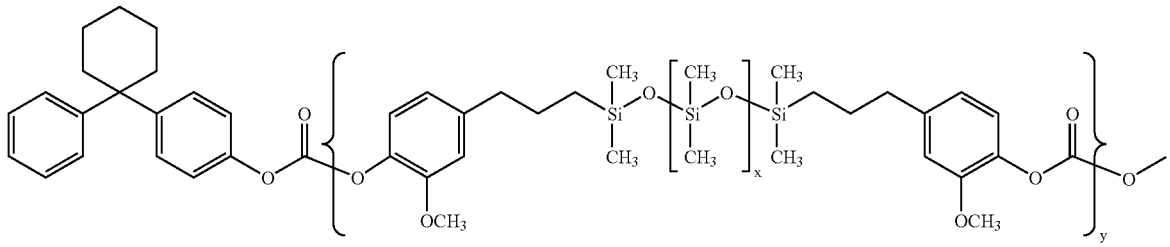

-continued
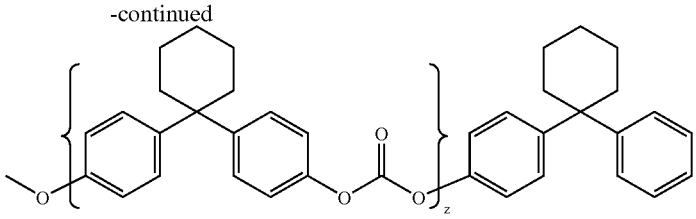
wherein x, y and z are integers representing a number of repeating units, and the second polymer is selected from the group consisting of
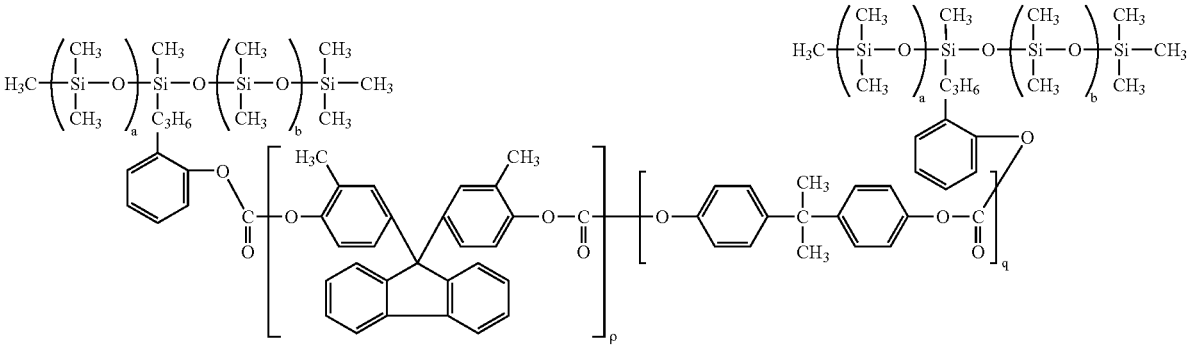
wherein a, b, p and q are integers representing a number of repeating units,
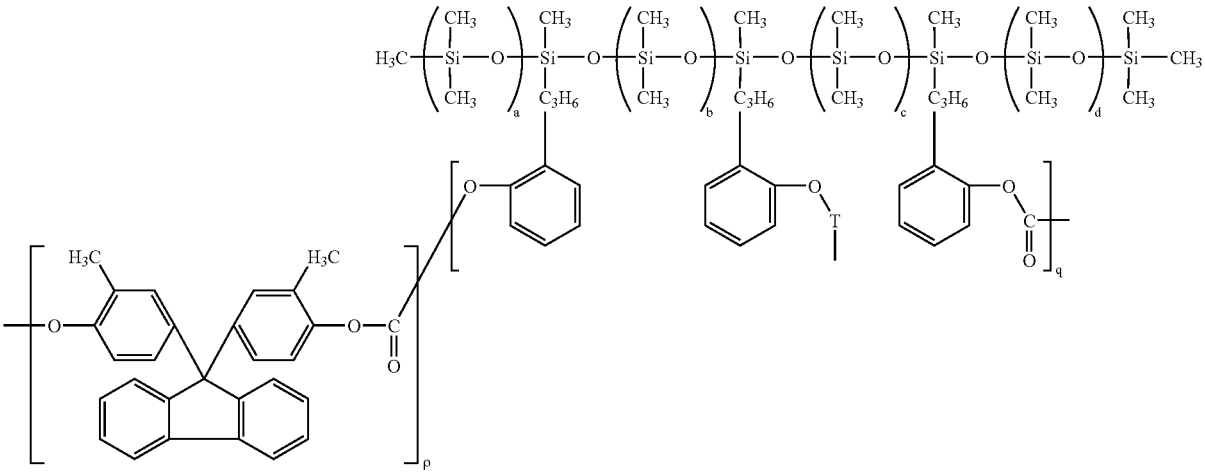

wherein a, b, c, d, p and q are integers representing a number of repeating units,
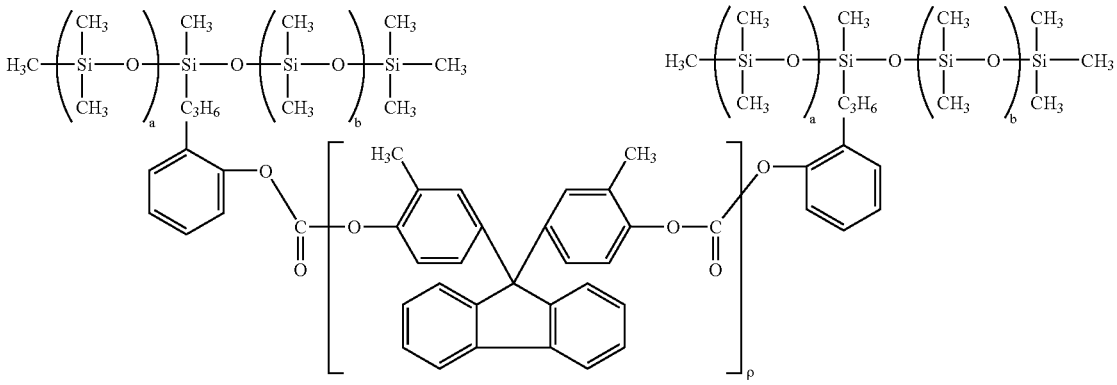
wherein a, b and p are integers representing the number of repeating units,
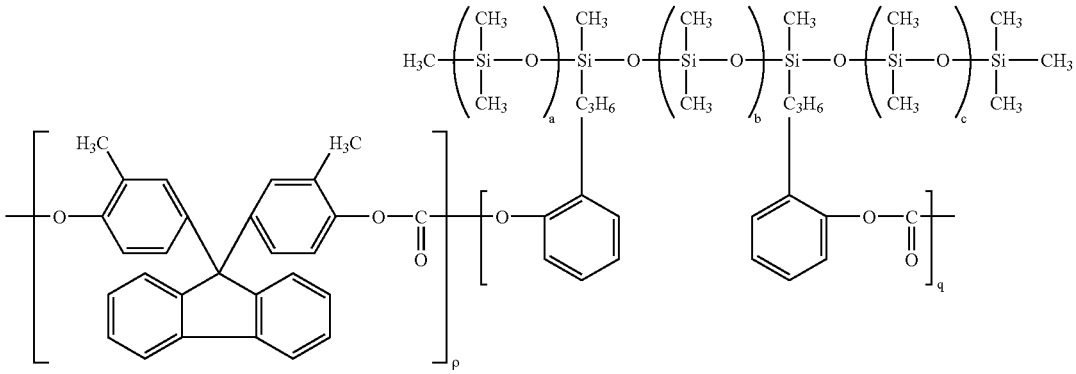
wherein a, b, c, p and q are integers representing the number of repeating units,
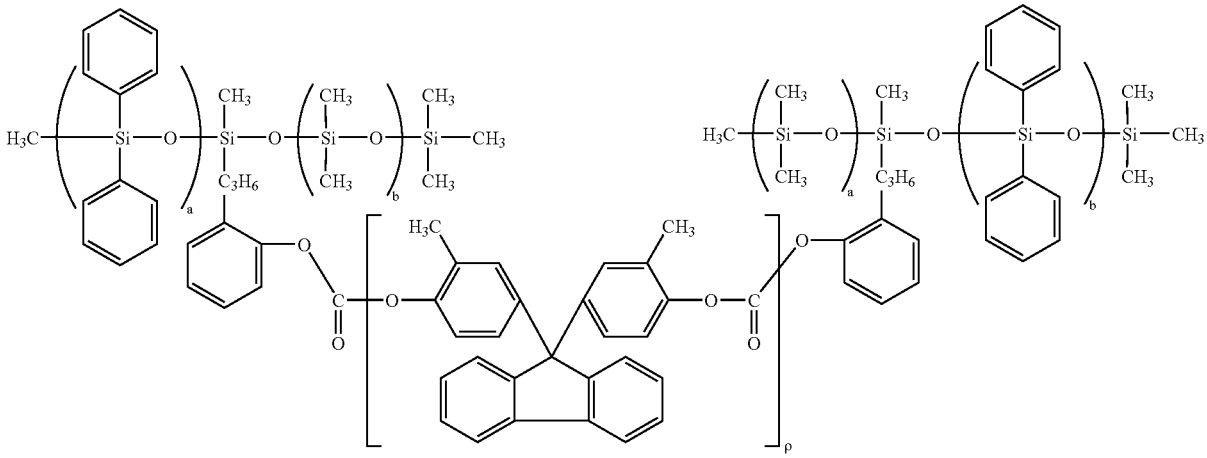

wherein the polymer has an polyalkyl and polyaryl siloxane main chain, and wherein a, b and p are integers representing the number of repeating units,

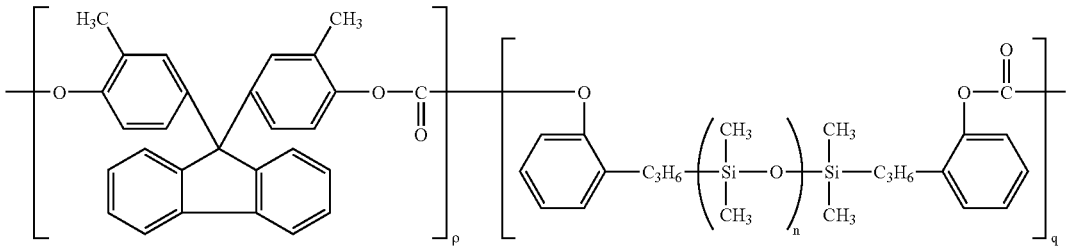

wherein a, p and q are integers representing the number of repeating units, and

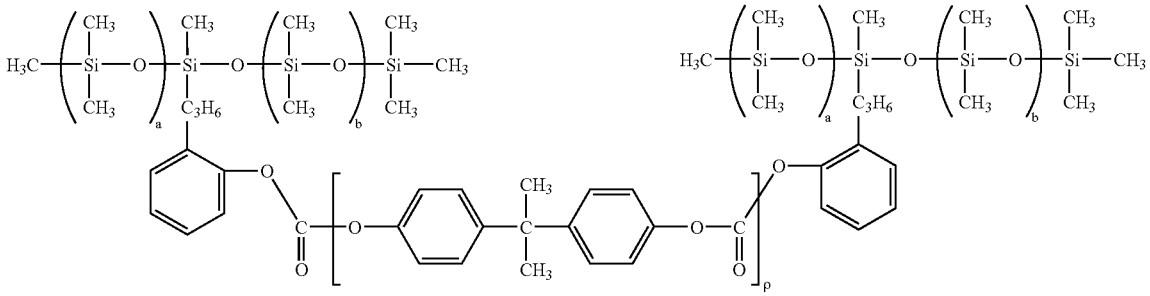

where a, b and p are integers representing the number of repeating units.

16. The image forming apparatus of claim 14, wherein the polyalkyl siloxane is polydimethyl siloxane.

17. The image forming apparatus of claim 14, wherein the first polymer and the second polymer are present in the anticurl back coating from about 99:1 to about 1:99 by weight ratio of the first polymer to the second polymer.

18. The image forming apparatus of claim 17, wherein the first polymer and the second polymer are present in the anticurl back coating from about 35:65 to about 65:35 by weight ratio of the first polymer to the second polymer.

19. The image forming apparatus of claim 14, wherein the anticurl back coating further includes an adhesion promoter.

20. The image forming apparatus of claim 14, wherein the anticurl back coating has a thickness of from about 5 micrometers to about 50 micrometers.

21. The image forming apparatus of claim 20, wherein the anticurl back coating has a thickness of from about 10 micrometers to about 20 micrometers.

22. The image forming apparatus of claim 14, wherein the first polymer and the second polymer have a weight average molecular weight of from about 20,000 to about 200,000.

* * * * *